US005636402A

United States Patent [19]

Kubo et al.

[11] Patent Number: 5,636,402

[45] Date of Patent: Jun. 10, 1997

[54] APPARATUS SPREADING FLUID ON FLOOR WHILE MOVING

[75] Inventors: Naoki Kubo, Nishinomiya; Shigeru Oyokota, Takatsuki; Nobukazu Kawagoe, Toyonaka, all of Japan

[73] Assignee: Minolta Co., Ltd., Osaka, Japan

[21] Appl. No.: 463,506

[22] Filed: Jun. 5, 1995

[30] Foreign Application Priority Data

| | | | |
|---|---|---|---|
| Jun. 15, 1994 | [JP] | Japan | 6-132862 |
| Jan. 24, 1995 | [JP] | Japan | 7-009055 |
| Mar. 24, 1995 | [JP] | Japan | 7-066381 |

[51] Int. Cl.[6] ..... A47L 11/03

[52] U.S. Cl. ..... 15/98; 15/50.1; 15/319; 15/320

[58] Field of Search ..... 15/49.1, 50.1, 15/50.2, 51, 52, 52.2, 97.1, 98, 319, 320; 118/263, 679, 707; 222/52, 330

[56] References Cited

U.S. PATENT DOCUMENTS

| | | | |
|---|---|---|---|
| 909,314 | 1/1909 | Murray et al. | 15/52 |
| 1,479,233 | 1/1924 | Gottlieb | 15/50.1 |
| 1,860,168 | 5/1932 | Bedard | 15/50.1 |
| 5,279,672 | 1/1994 | Betker et al. | 15/319 |
| 5,380,366 | 1/1995 | Becker et al. | 222/52 |

FOREIGN PATENT DOCUMENTS

| | | | |
|---|---|---|---|
| 5-39455 | 5/1993 | Japan . | |
| 5-204447 | 8/1993 | Japan . | |
| 564459 | 9/1944 | United Kingdom | 15/319 |

*Primary Examiner*—David Scherbel
*Assistant Examiner*—Terrence Till
*Attorney, Agent, or Firm*—Burns, Doane, Swecker & Mathis, LLP

[57] ABSTRACT

An apparatus of spreading a fluid on the floor includes four rectangular application rotating bodies partially overlapping each other, and four nozzles supplying the fluid provided in rotation areas of the respective application rotating bodies. The rotation position of the application rotating body is detected by a light shielding plate and a photosensor. A control portion controls each component so that the fluid is applied onto the floor from a tank through the nozzle by a pump when the application rotating body is not directly under the nozzle. As a result, the apparatus of spreading a fluid on the floor capable of optimally controlling the quantity of the fluid to be applied according to the application condition can be provided.

23 Claims, 38 Drawing Sheets

4
11
2
d
d
d
L
ROTATION DIRECTION
15

16
d
d
d
4
11
2
L
ROTATION DIRECTION
15

APPARATUS SPREADING FLUID ON FLOOR WHILE MOVING

BACKGROUND OF THE INVENTION

1. Field of the Invention

The present invention generally relates to apparatus of spreading a fluid on the floor used in a floor washing and mopping work, a waxing work, a work of spreading in hospital or the like an antiseptic solution on the floor, or the like, and more particularly, to an apparatus of spreading a fluid on the floor applied to a cleaning robot which carries out the above work while autonomously running.

2. Description of the Related Art

In a conventional apparatus of spreading a fluid on the floor, a fluid is applied onto the floor by a rotating sponge, brush, or the like, containing the fluid being abutted on the floor, or by spraying the fluid on the floor and brushing the sprayed fluid.

A method of applying a fluid onto the floor of a larger area is disclosed in Japanese Patent Laying-Open No. 5-204447, for example. According to this gazette, a plurality of rotating bodies which abut on the floor are provided, and these rotating bodies are closely rotated while being deformed with respect to each other, thereby eliminating an unmopped area between the rotating bodies.

On the other hand, an autonomously running working vehicle is also commercially available. In such an autonomously running working vehicle, floor pads corresponding to various cleaning works are attached at a lower portion of the working vehicle. Wax or the like is dropped into these floor pads according to what kind of cleaning work is to be carried out, and the cleaning work is carried out.

In the above described conventional apparatus of spreading a fluid on the floor, the fluid is once contained by a sponge or the like, causing the following problems. More specifically, it is necessary to control the quantity of the fluid contained by the sponge in order to apply the fluid onto the floor uniformly. However, it is difficult to control the quantity of the fluid contained. At the time of start of the work, the quantity of applied fluid is insufficient. On the other hand, at the time of end of the work, even if supply of the fluid to the sponge is stopped, the sponge has already contained more fluid than necessary, resulting in excessive application of the fluid. Further, the quantity of the fluid to be applied might change depending on the moving speed.

In a method of spreading the fluid by spraying, particulates of the fluid float in the air. Some fluids do harm to a human body.

In spreading the fluid by closely rotating a plurality of rotating bodies while deforming the same with respect to each other in order to carry out the work on the floor having a larger area, the rotating bodies containing the fluid are deformed in portions where they are closely in contact with each other, causing squeeze of the rotating bodies, concentration of the fluid, and generation of bubbles. As a result, tracks of the fluid are left on the floor after the work.

The autonomously running working vehicle advantageously allows anyone to easily carry out the cleaning work. However, it is difficult to carry out cleaning uniformly up to every corner of the floor as if one cleans the floor with a mop. In a mop-type working apparatus, the operator must depend solely on his intuition and experience in order to supply an appropriate amount of fluid. When a beginner uses the mop-type working apparatus, the fluid is excessively applied onto the floor, or the fluid is insufficiently applied onto the floor.

Further, in the conventional apparatus of cleaning the floor, wheels of the apparatus pass on the floor after the cleaning work. Therefore, the wheels may get the floor after cleaned dirty.

SUMMARY OF THE INVENTION

One object of the present invention is to provide an apparatus of spreading a fluid on the floor capable of optimally controlling the quantity of the fluid to be applied according to the application condition.

Another object of the present invention is to provide an apparatus of spreading a fluid on the floor which is not affected by the moving speed.

Still another object of the present invention is to provide an apparatus of spreading a fluid on the floor which does not affect a human body with the fluid to be applied.

A further object of the present invention is to provide an apparatus of spreading a fluid on the floor capable of finishing the entire surface to which the fluid is applied even when a plurality of rotating bodies are provided.

A further object of the present invention is to provide a working apparatus with which one can carry out a cleaning work uniformly as if one uses a mop.

A further object of the present invention is to provide a working apparatus whose wheels do not get a surface after being cleaned dirty.

The above objects of the present invention are accomplished by an apparatus of spreading a fluid on a surface including the following components. More specifically, according to one aspect of the present invention, the spreading apparatus includes a working unit having a working member which moves along a predetermined path, and a supplier supplying a fluid over the predetermined path. When the working member is located under the supplier, supply of the fluid from the supplier is stopped.

Therefore, when the working member is not located under the supplier, a necessary quantity of fluid is provided from the supplier. As a result, the apparatus of spreading a fluid on the floor can be provided which is capable of optimally controlling the quantity of fluid to be applied according to the application condition.

According to another aspect of the present invention, the spreading apparatus includes a working unit having a working member which spreads a fluid, a supplier supplying the fluid, and a speed detector detecting a moving speed of the apparatus. The amount of drop of the fluid from the supplier is controlled based on a detection value of the speed detector. As a result, anyone can apply the fluid onto the floor uniformly with this apparatus as if one operates a mop.

According to still another aspect of the present invention, the spreading apparatus includes a working unit capable of moving on the floor. The working unit has first and second wheels selectively coming in contact with the floor according to the moving direction. Since different wheels come in contact with the floor according to the moving direction of the working unit, the wheels of the working unit can be adjusted so as not to come in contact with the floor according to the moving direction. As a result, a surface to which the working unit has carried out a work does not get dirty by the wheels.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS (1) First Embodiment

Figure 1:
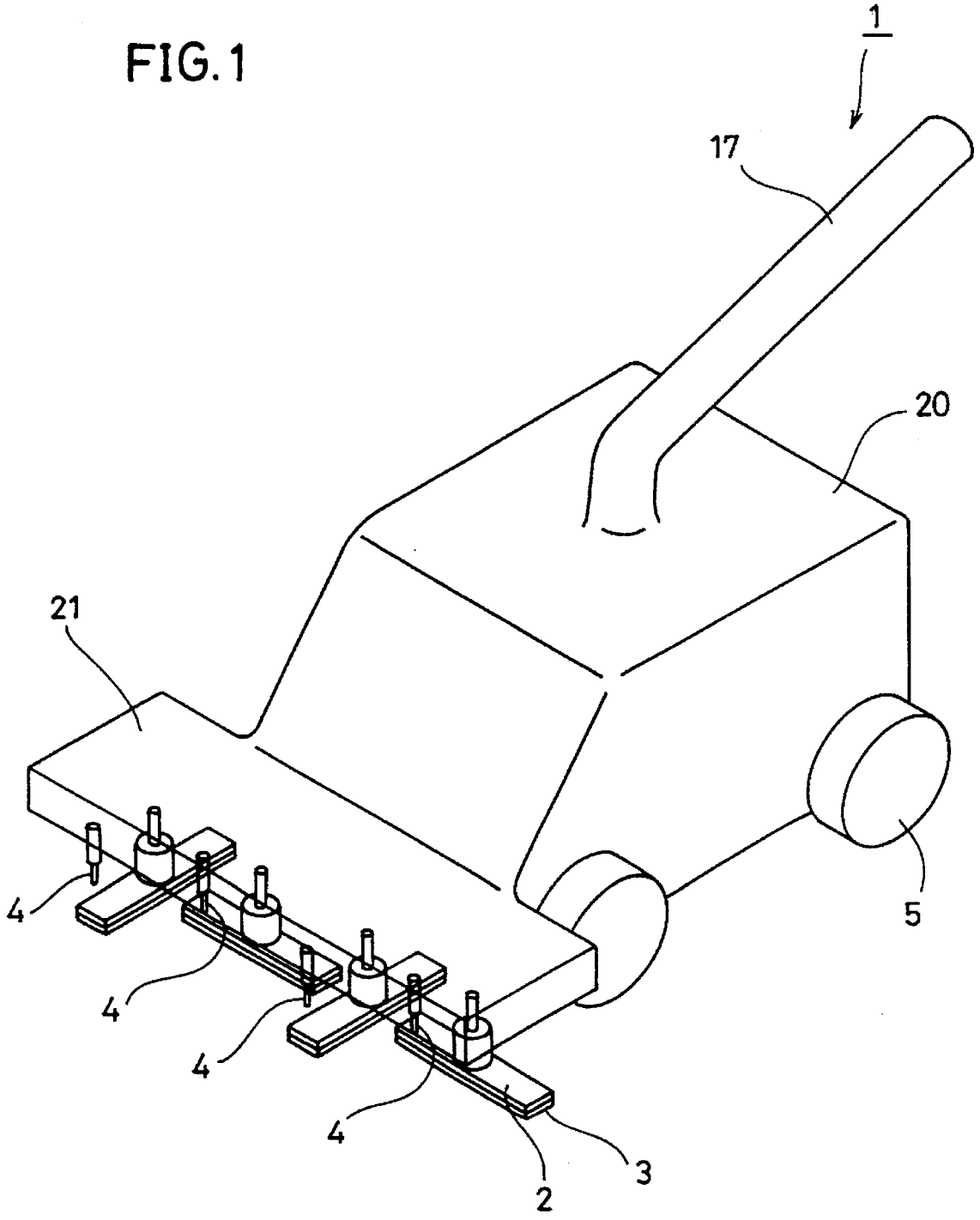
FIG. 1 is a perspective view of an appearance of a cleaning robot on which an apparatus of spreading a fluid according to a first embodiment of the present invention is mounted.

Embodiments of the present invention will be described hereinafter with reference to the drawings. FIG. 1 is a perspective view of an appearance of a cleaning robot 1 on which the apparatus of spreading a fluid on the floor according to the first embodiment of the present invention is mounted as a floor cleaning apparatus.

Referring to FIG. 1, cleaning robot 1 includes a body 20, wheels 5 provided around body 20 for moving cleaning robot 1, a supporting portion 21 supporting the spreading apparatus provided at a front end of body 20, and a handle 17 provided at an upper portion of body 20 for serving as a holding portion when cleaning robot 1 is manually moved. Supporting portion 21 is provided with four application rotating bodies 2 rotating while abutting on the floor and applying a cleaning fluid onto the floor, nonwoven fabric cloths 3 fixed to respective lower portions of application rotating bodies 2, and nozzles 4 for jetting the cleaning fluid to respective application rotating bodies 2.

A thin sheet-shaped nonwoven fabric cloth is used as nonwoven fabric cloth 3 in this embodiment so that nonwoven fabric cloth 3 contains an appropriate quantity of fluid to prevent uneven application. Nonwoven fabric cloth 3 serves to adhere to the dirt on the floor. When the dirt is attached to nonwoven fabric cloth 3, the dirty nonwoven fabric cloth can be replaced with a new one. Nozzle 4 is positioned at an upper portion in an application range of application rotating body 2, and jets the cleaning fluid towards the floor in synchronism with rotation of application rotating body 2.

Although the fluid jet from nozzle 4 is a cleaning fluid in this embodiment, this spreading apparatus is effective in the case where wax, paint, an antiseptic solution, or the like is used.

Figure 2:
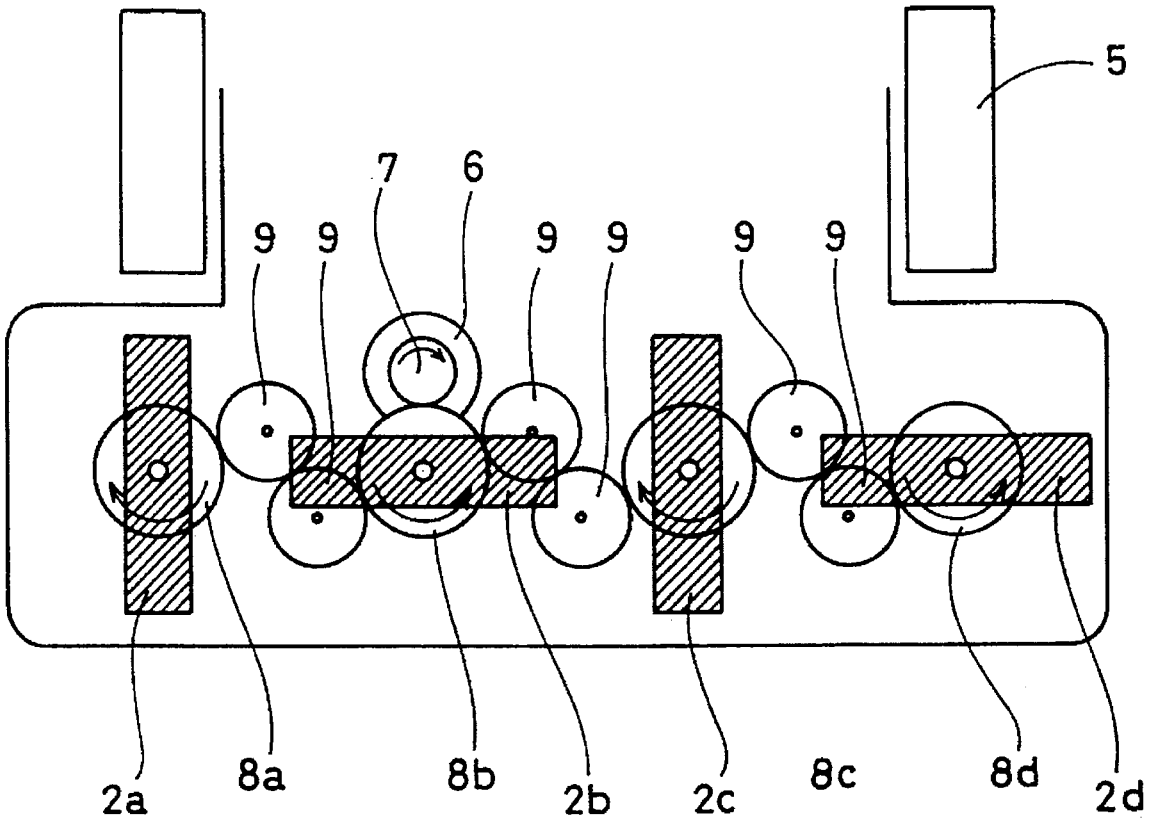
FIG. 2 is a diagram showing a drive mechanism of application rotating bodies.

FIG. 2 is a schematic diagram showing a mechanism of driving application rotating body 2, with supporting portion 21 seen from above.

Referring to FIG. 2, the mechanism of driving application rotating body 2 includes a driving motor 6, a driving gear 7 directly coupled to driving motor 6, and a driving gear 8*b* engaged with driving gear 7 and directly coupled to application rotating body 2*b*. Application rotating bodies 2*a*, 2*c*, and 2*d* are rotated by driving gears 8*a*, 8*c*, and 8*d* directly connected thereto, respectively, being driven through adjacent idle gears 9.

Referring to FIG. 2, when driving motor 6 rotates in the direction indicated by an arrow, application rotating bodies 2*a* to 2*d* rotate in the directions indicated by arrows at the same speed. Although four application rotating bodies 2*a* to 2*d* are driven using gears in this embodiment, the present invention is not limited thereto. The application rotating bodies can be driven similarly using belts or pulleys.

Figure 3:
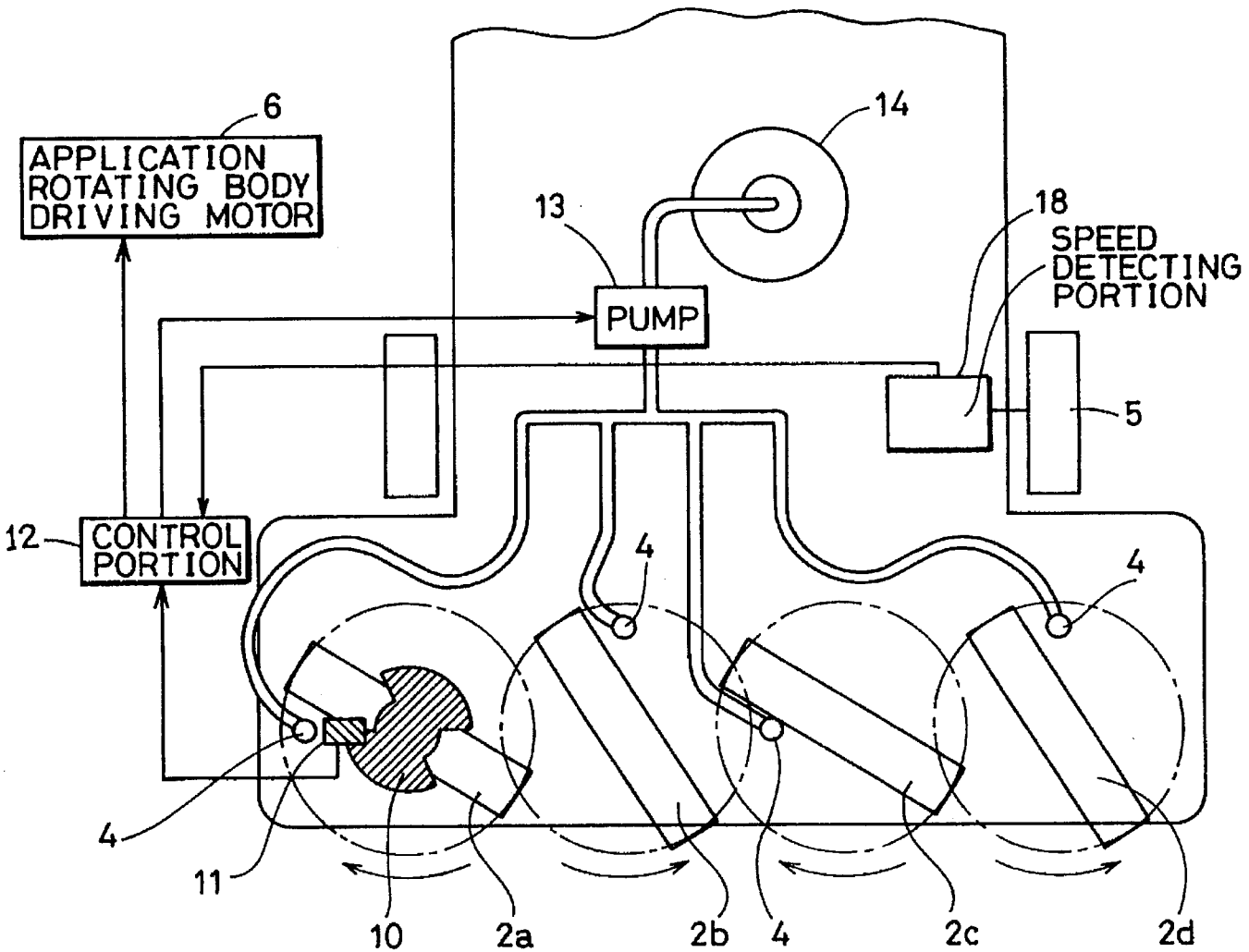
FIG. 3 is a diagram showing a mechanism of jetting a cleaning fluid from nozzles in synchronism with rotation of the application rotating bodies.

FIG. 3 is a diagram for explaining a mechanism of jetting the cleaning fluid from nozzle 4 in synchronism with rotation of application rotating body 2. Referring to FIG. 3, the cleaning fluid is stored in a tank 14. The cleaning fluid is fed to nozzles 4 provided in respective areas of the four application rotating bodies by a pump 13. Pump 13 is controlled by a control portion 12. Control portion 12 detects a running speed of cleaning robot 1 in response to a signal based on rotation of application rotating body 2 and through a speed detecting portion 18, and controls pump 13 and driving motor 6. The content of control will be described later.

Rotation of application rotating body 2*a* is detected by a light shielding plate 10 directly coupled to application rotating body 2*a*, and a photosensor 11 provided at a prescribed position with respect to light shielding plate 10. The detected signal is input to control portion 12. Control portion 12 controls operation of pump 13 in synchronism with the signal. Light shielding plate 10 is provided with two notch portions corresponding to the shape of application rotating body 2*a*, as shown in FIG. 3. In this embodiment, operation of the pump is programmed to stop upon detection of the notch portions by photosensor 11.

According to operation of pump 13, the cleaning fluid stored in tank 14 is fed to nozzle 4, and the cleaning fluid is jet from the tip of nozzle 4. Such a structure enables the cleaning fluid to be jet from nozzle 4 in synchronism with rotation of application rotating body 2.

As described above, wheel 5 is provided with speed detecting portion 18, by which the running speed of cleaning robot 1 is detected. A method of detecting the running speed will be described later. The detected running speed is input to control portion 12, and control portion 12 controls driving motor 6 and pump 13 according to the signal. As a result, the rotation speed of application rotating body 2 and the quantity of drop of the cleaning fluid which are always optimal with respect to the running speed can be obtained. If the running speed is determined to be faster than the reference speed, for example, control portion 12 increases the duty value of driving motor 6 to increase the rotation speed of application rotating body 2 and to decrease mopping variation. Further, control portion 12 increases the duty value of pump 13 to drop more cleaning fluid and to keep the quantity of fluid to be applied constant.

Conversely, if the running speed is determined to be slower than the reference period, control portion 12 decreases the duty values of driving motor 6 and pump 13, so that the same application effect as that of high speed operation can be obtained.

As described above, the rotation speed of application rotating body 2 can be controlled corresponding to the running speed of cleaning robot 1. Therefore, uniform and constant application of the fluid onto the floor can be implemented independently of the running speed. This mechanism is particularly effective at the time of handwork in which the running speed of the cleaning robot cannot be kept constant.

Figures 4A, 4B, 4C, 4D, 4E, 4F, 4G:
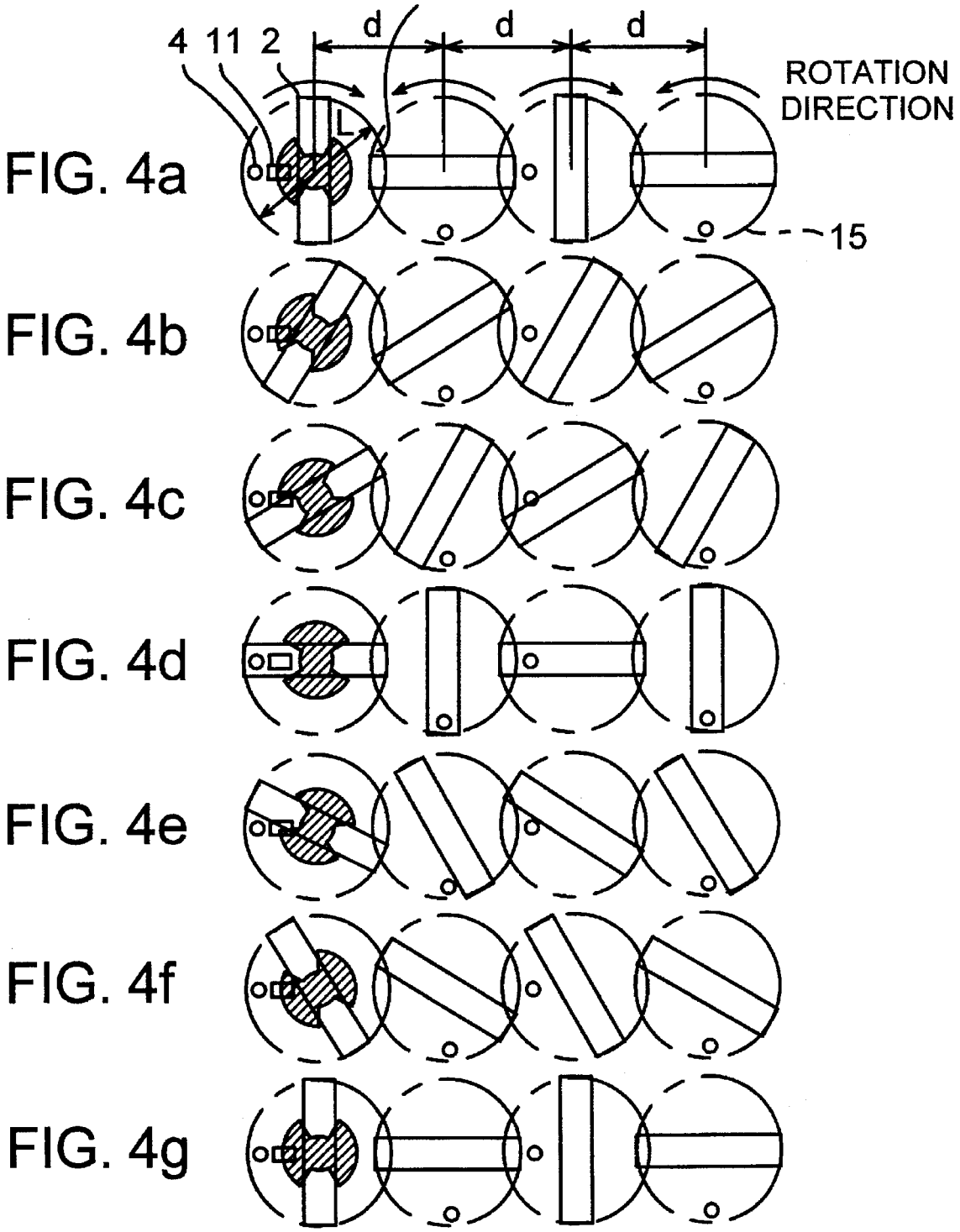
FIG. 4 is a diagram showing an operation pattern of rotation of the application rotating bodies and an operation pattern of jetting the cleaning fluid.

FIG. 4 is a diagram showing an operation pattern of rotation of application rotating body 2, and an operation pattern of jetting the cleaning fluid from nozzle 4 in synchronism with rotation of application rotating body 2.

Referring to FIG. 4, application rotating body 2 has a diameter of L. Respective application rotating bodies 2 are arranged with the distance d between rotation centers. The diameter L of a mopping area 15 of application rotating body 2 is longer than the distance d, so that there exists a mopping overlapping area 16 in which adjacent mopping ares 15 overlap with each other.

In an initial state (a), four application rotating bodies 2 are aligned with a phase difference of 90° as shown in the figure. The application rotating bodies start to rotate at the same speed in the directions indicated by arrows, respectively, from the initial state. A state in which the application rotating bodies are rotated in prescribed rotation directions by 30° from the initial state (a) is shown at (b). Then, similarly, the application rotating bodies rotate as (c), (d), . . . . A state is shown at (g) where the application rotating bodies are rotated by 180° from the state (a). In this state, application rotating bodies 2 are aligned similarly to the case of the state (a). By repeating this cycle, the application rotating bodies can rotate without interfering with each other.

As described above, adjacent rotating bodies rotate in synchronism with each other while keeping a prescribed phase difference therebetween. Therefore, mopping areas by the rotating bodies rotate with an overlapping portion therebetween, and the rotating bodies do not interfere with each other. As a result, uniform application of the fluid onto the floor can be implemented over the entire width of the plurality of rotating bodies.

Referring to FIG. 4, the operation pattern of jetting the cleaning fluid from nozzle 4 in synchronism with rotation of application rotating body 2 will be described.

As described above, control is made so that jet of the cleaning fluid from nozzle 4 is interrupted upon detection of the notch portions of light shielding plate 10 by photosensor 11. Therefore, in the states of (a) and (b), the cleaning fluid is jet towards the floor. However, in the state of (c), photosensor 11 detects the notch portions of light shielding plate 10 to stop pump 13, so that jet of the cleaning fluid by nozzle 4 is interrupted. Further, in the states of (d) and (e), photosensor 11 does not detect the notch portions of light shielding plate 10. Therefore, pump 13 is again operated to start jetting of the cleaning fluid. The application rotating bodies further rotate as shown at (f) and (g), and again return to the initial state of (a).

As shown in FIG. 4, the notch portions of light shielding plate 10 are provided corresponding to the shape of application rotating body 2. Therefore, it is possible to directly jet the cleaning fluid only to the floor without jetting the cleaning fluid to the upper surface of application rotating body 2. The cleaning fluid jet to the floor is spread on the floor by nonwoven fabric cloth 3 fixed to a portion of application rotating body 2 abutting on the floor. By rotating wheels 5 and moving cleaning robot 1 forward, the cleaning fluid can be applied onto the floor uniformly over the entire width (L+3d) of mopping areas 15.

Further, control of the quantity of application according to the output of speed detecting portion 18 or the like can be implemented by changing the setting of the number of pump operations with respect to a signal from photosensor 11 in control portion 12. More specifically, by controlling the quantity of applied fluid from two jets of the cleaning fluid per one rotation of application rotating body 2 to one jet per one rotation, one jet per two rotations, . . . , the quantity of application can be controlled freely.

As described above, according to this embodiment, the quantity of the fluid to be dropped on the floor can be changed corresponding to the speed of the cleaning robot. Therefore, the quantity of application can be adjusted to be optimal according to the speed of the cleaning robot.

Figures 5A, 5B, 5C, 5D, 5E, 5F, 5G:
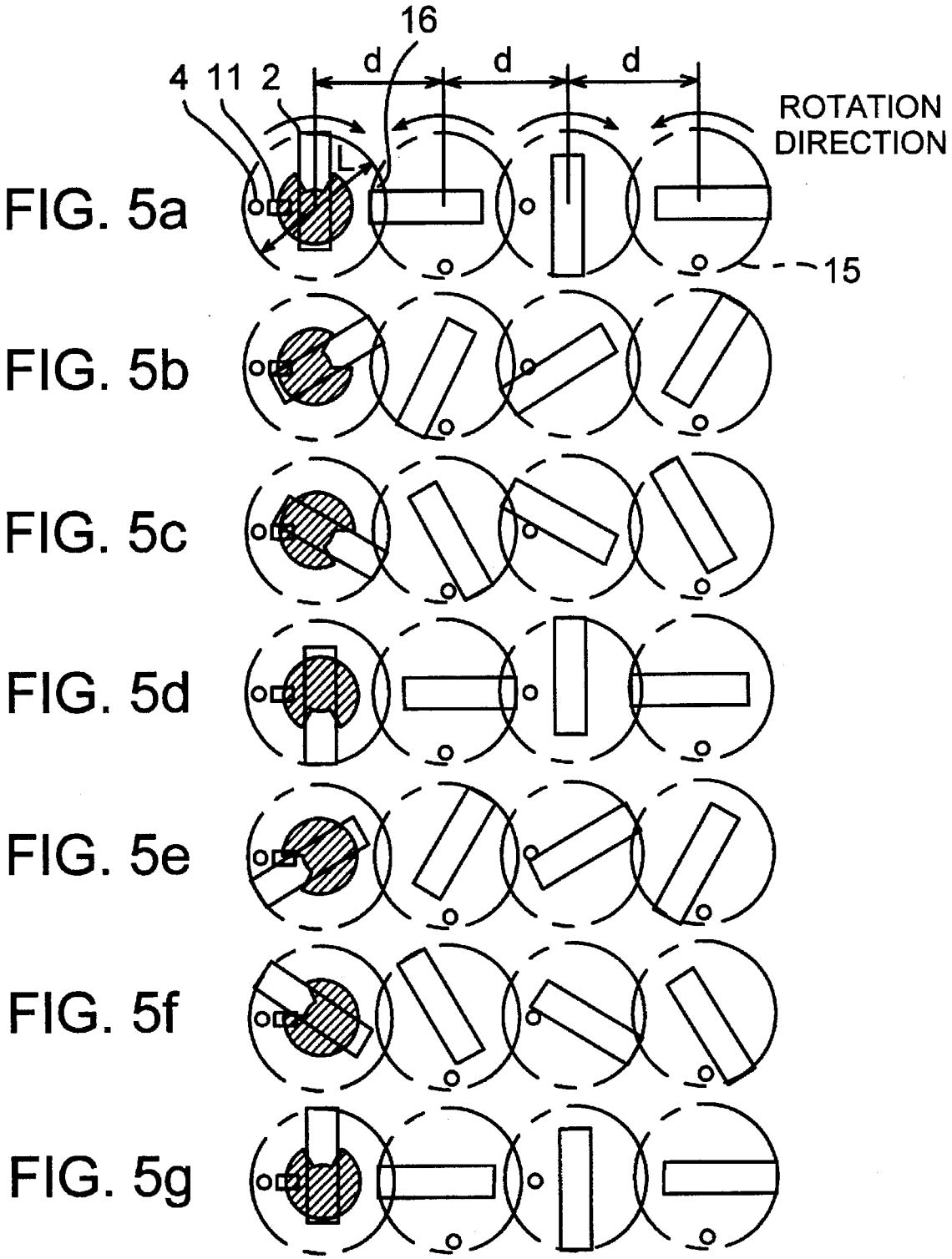
FIG. 5 is a diagram showing a modification of the first embodiment of the present invention.

FIG. 5 is a diagram showing a modification of the first embodiment. In this modification, the length of a portion of application rotating body 2 abutting on the floor is shortened on one side so that one end of the portion abutting on the floor is positioned closer to the rotation center than nozzle 4, and the corresponding notch portion of light shielding plate 10 is filled in. As a result, jet of the fluid is stopped only at (e) and (f) during one rotation. This is one half of the case of the embodiment shown in FIG. 3, making it possible to apply more cleaning fluid onto the floor.

In this case, the shape of application rotating body 2 is not symmetrical with the rotation center. Rotation of the application rotating body generates a repulsive force from the floor, causing shift of the axis center. This might cause vibration of the entire apparatus of spreading a fluid on the floor. Therefore, in applying this modification to a light-weight cleaning robot, the shape of application rotating body 2 must be in symmetry with respect to the rotation center, and adjacent rotating bodies must rotate in the opposite directions, in order to minimize vibration. In any case, irrespective of the weight of the cleaning robot, it is desirable that the shape of the application rotating body is in symmetry with respect to the rotation center in order to prevent vibration completely.

Figure 6:
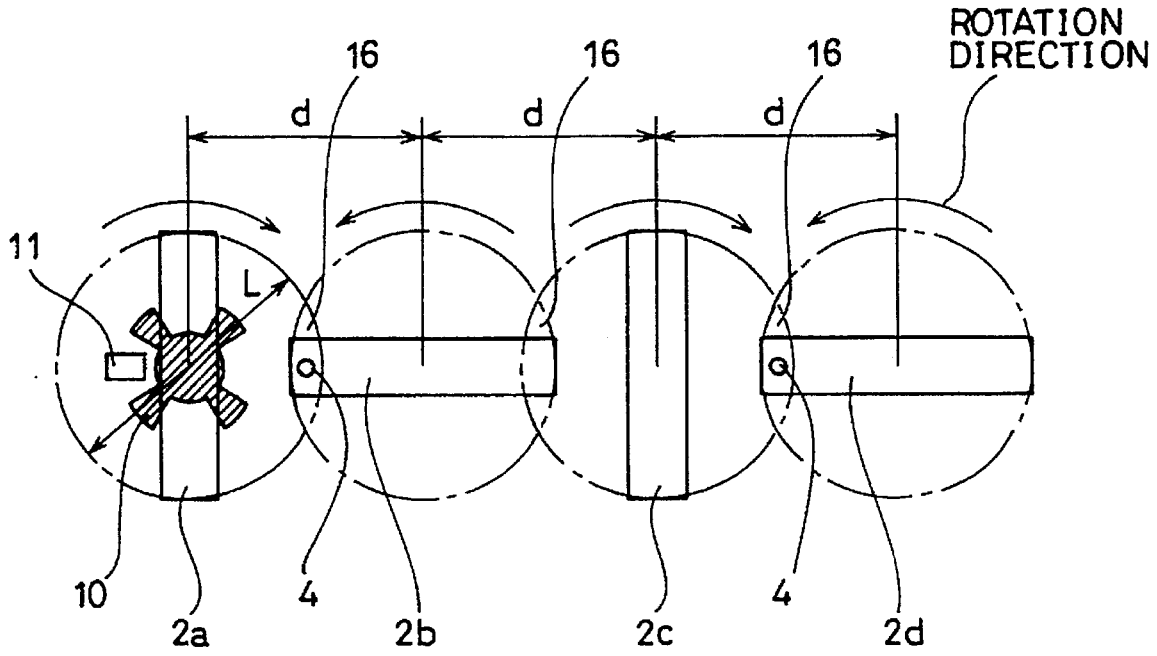
FIG. 6 is a diagram showing another modification of the first embodiment of the present invention.

Another modification of the first embodiment will now be described with reference to FIG. 6. In this modification, nozzle 4 for jetting the cleaning fluid is provided in each of mopping overlapping ares 16 on both sides excluding mopping overlapping area 16 at the center. By thus structured, the number of nozzles can be reduced to two, making it possible to reduce the cost as compared to the above embodiment. In this case, in order to avoid dropping of the fluid on two application rotating bodies 2 sharing mopping overlapping area 16, light shielding plate 10 is provided with four notch portions.

(2) Second Embodiment

Figure 7:
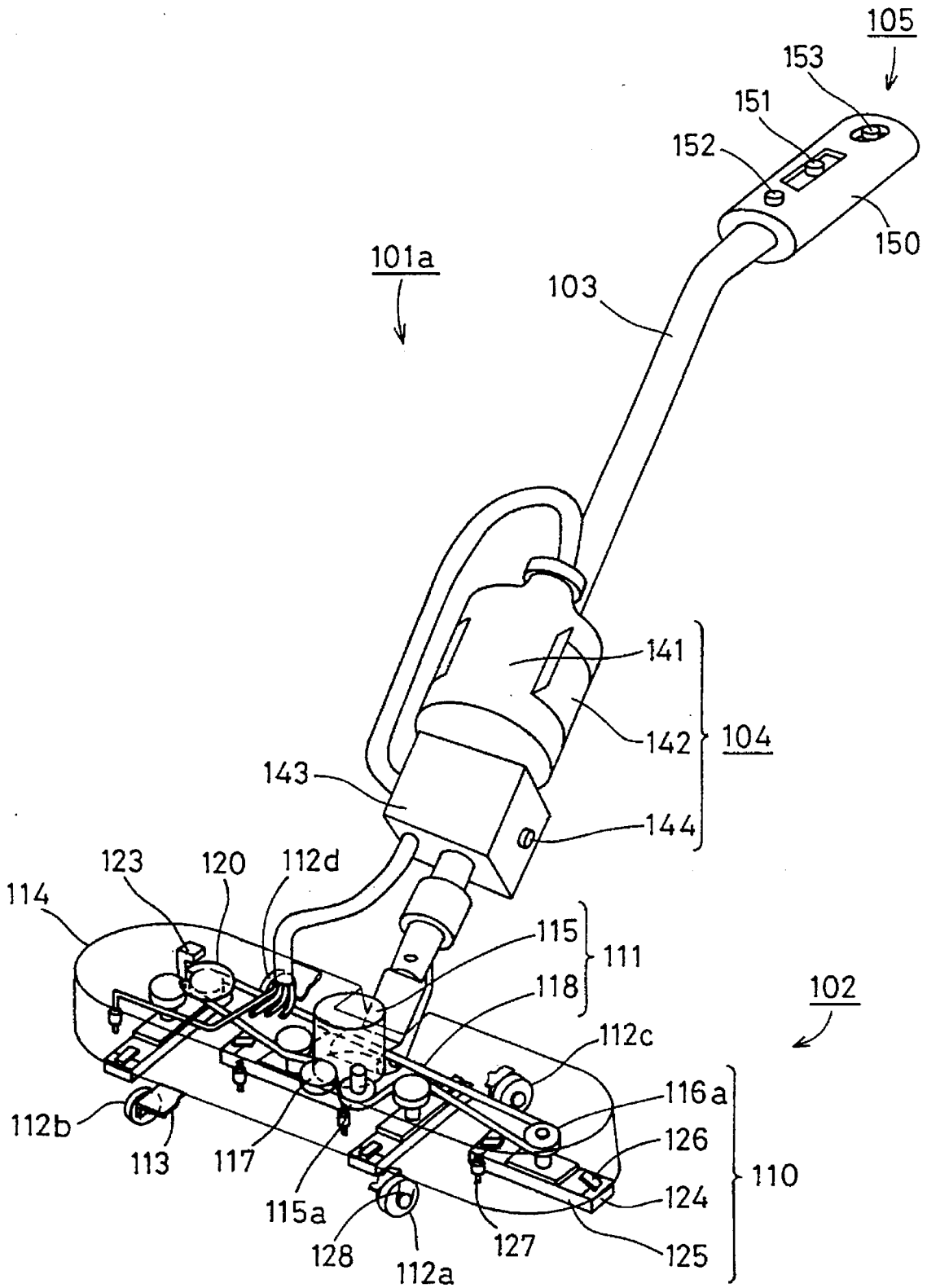
FIG. 7 is a schematic diagram showing the entire structure of a floor cleaning apparatus according to a second embodiment of the present invention.

FIG. 7 is a schematic view showing an appearance of a floor cleaning apparatus according to the second embodiment of the present invention. In this embodiment, the present invention is applied not to a cleaning robot, but to an ordinary floor cleaning apparatus. This embodiment is different from the first embodiment in the shape of the application rotating body. Referring to FIG. 7, a floor cleaning apparatus 101*a* according to this embodiment includes a mopping portion 102 actually carrying out a cleaning work, a supporting portion 103 supporting mopping portion 102, a grip portion 105 connected to supporting portion 103 and carrying out operation at the time of cleaning, and a fluid holding portion 104 provided at supporting portion 103.

Mopping portion 102 includes a wheel holder plate 113 connected to supporting portion 103 and supporting a wheel 112 for moving mopping portion 102 to a desired position at the time of cleaning, a plurality of nonwoven fabric cloth holding portions 110 each provided on wheel holder plate 113 and holding a nonwoven fabric cloth 124 (corresponding to the application rotating body of the first embodiment) abutting on the floor and actually cleaning the floor, and a nonwoven fabric cloth rotation mechanism 111 rotating nonwoven fabric cloth holding portions 110. Mopping portion 102 is entirely covered with a cover 114.

Nonwoven fabric cloth holding portion 110 includes a nonwoven fabric cloth turntable 125 holding nonwoven fabric cloth 124, a nonwoven fabric cloth clip 126 fixing nonwoven fabric cloth 124 to nonwoven fabric cloth turntable 125, and a driven pulley 116 holding nonwoven fabric cloth turntable 125 rotatably. Four sets of nonwoven fabric cloth holding portions 110 are provided as shown in the figure, and these portions are mutually driven through nonwoven fabric cloth rotation mechanism 111. A fluid drop nozzle 127 is provided in the vicinity of each nonwoven fabric cloth turntable 125. Adjacent mopping areas of four nonwoven fabric cloth turntables 125 partially overlap with each other. However, by rotating adjacent nonwoven fabric cloth turntables with a phase difference, these nonwoven fabric cloth turntables do not interfere with each other. In addition, a mopping work can be carried out without an area to which the fluid is not applied.

Unlike the first embodiment, nonwoven fabric cloth rotation mechanism 111 includes a double-toothed timing belt 118 mutually rotating nonwoven fabric cloth turntables 125 through driven pulleys 116 provided at upper portions of four sets of nonwoven fabric cloth holding portions 110, and a driving motor 115 driving double-toothed timing belt 118. The details of nonwoven fabric cloth rotation mechanism 111 will be described later.

Fluid holding portion 104 includes a fluid tank 141 storing the fluid, a tank holder 142 integrally holding fluid tank 141 to holding portion 103, a fluid supplying portion 143 receiving the fluid from fluid tank 141 and feeding the fluid to mopping portion 102, and a fluid manually supplying switch 144 provided at fluid supplying portion 143 for supplying the fluid from fluid tank 141 to fluid drop nozzle 127 before start of the mopping work. Fluid supplying portion 143 includes a fluid drop pump, a battery serving as a drive source, and a control circuit, not shown.

Grip portion 105 includes a grip 150 serving as an operating portion for operating the entire floor cleaning apparatus 101, and a switch 151 provided on grip 150 and switching power supply and mode. Floor cleaning apparatus 101*a* according to the second embodiment operates in two modes: a fluid drop mode in which the floor cleaning apparatus mops the floor while dropping the fluid; and a dry mopping mode in which the apparatus drymops the floor without dropping the fluid. Grip 150 is provided with a switch 152 for dropping the fluid in the dry mopping mode and an adjustment volume 153 for adjusting the quantity of the fluid to be dropped. Switch 152 in the dry mopping mode is used in the case where the apparatus carries out the work usually in the dry mopping mode, and where the apparatus carries out the mopping while dropping the fluid still in the dry mopping mode when it encounters an extremely dirty portion on the floor.

The apparatus can carry out the mopping work not only in the mopping mode in which the apparatus carries out the mopping work while dropping the fluid, but also in the dry mopping mode in which the apparatus carries out the mopping work without dropping the fluid by provision of a switch switching the operation mode to the dry mopping mode. If the operator finds an extremely dirty portion on the floor during the mopping work in the dry mopping mode, the operator may switch the operation mode from the dry mopping mode to the mopping mode, or the operator may operate switch 152 in the dry mopping mode. As a result, the operator can carry out the mopping work while intensively dropping the fluid on the portion with the apparatus still in the dry mopping mode.

Figure 8:
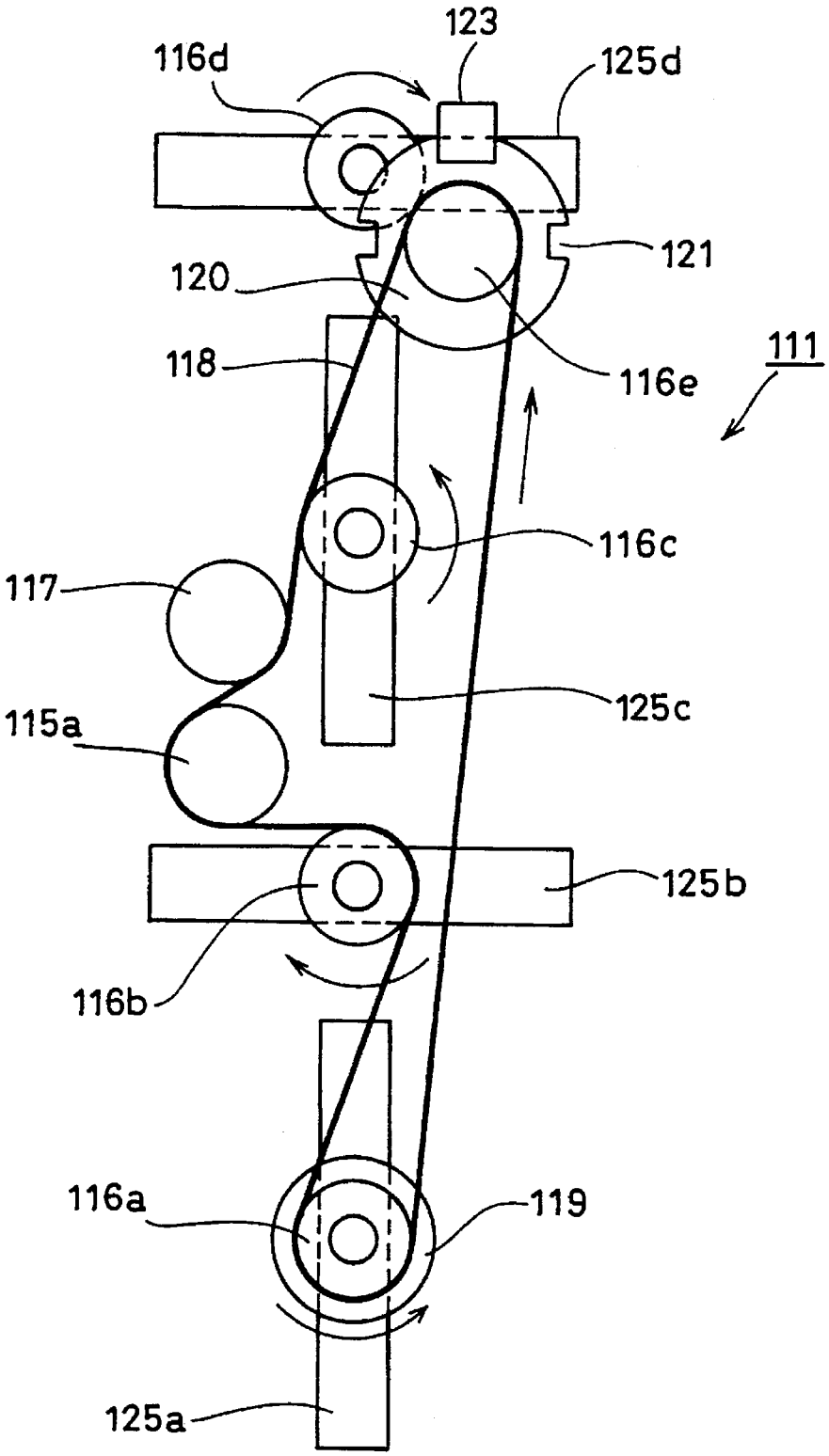
FIG. 8 is a plan view of a mechanism of controlling rotation of nonwoven fabric cloths.

FIG. 8 is a plan view showing mopping portion 102 from the side of cover 114. Referring to FIG. 8, nonwoven fabric cloth rotation mechanism 111 will be described in detail. As described above, four nonwoven fabric cloth turntables 125*a* to 125*d* provided adjacent to each other are provided with driven pulleys 116*a* to 116*d* for rotating the same, respectively. Double-toothed timing belt 118 is wound around driven pulleys 116*a* to 116*d*. By driving double-toothed timing belt 118 by a driving pulley 115*a* connected to driving motor 115, nonwoven fabric cloth turntables 125*a* to 125*d* are rotated in the directions indicated by arrows in the figure. An idle pulley 117 is provided adjacent to driving pulley 115*a* in order to adjust the tension of double-toothed timing belt 118. Driven pulley 116*a* is provided with a rotation encoder 119 for generating a pulse in synchronism with rotation of nonwoven fabric cloth turntable 125. Rotation encoder 119 detects the rotation speed of nonwoven fabric cloth turntables 125*a* to 125*d*. A driven pulley 116*e* slidably rotating with driven pulley 116*d* for rotating nonwoven fabric cloth turntable 125*d* is provided with a drop timing pulse disc 120 provided concentrically with driven pulley 116*e* and having a notch portion 121 corresponding to a drop timing position. By a photointerrupter 123 detecting notch portion 121, the drop timing is detected. Therefore, the fluid can be directly dropped onto the floor without being spread on nonwoven fabric cloth turntables 125*a* to 125*d* at the time of dropping of the fluid.

Figure 9:
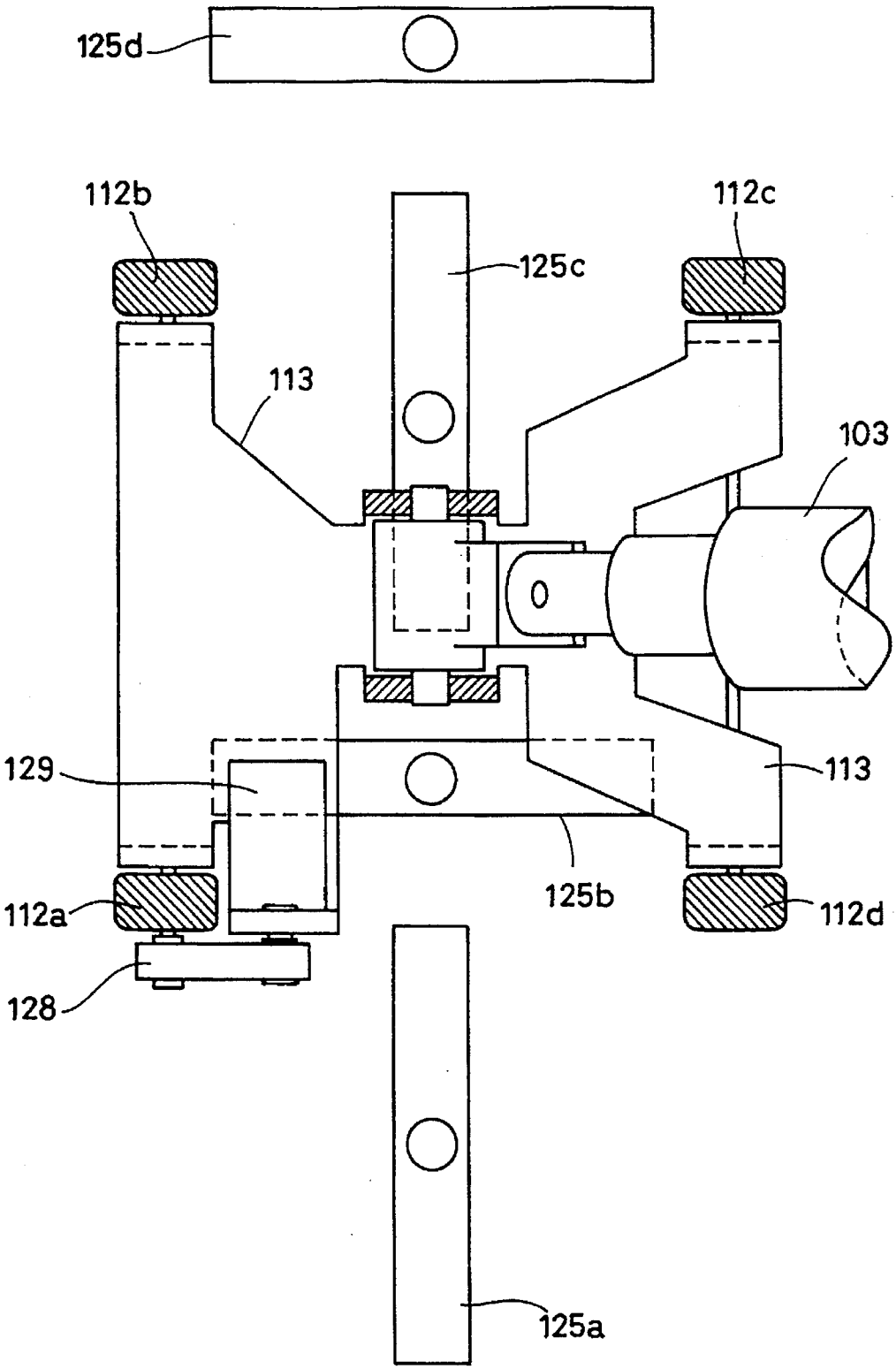
FIG. 9 is a diagram showing the positional relationship between nonwoven fabric cloth turntables and wheels according to the second embodiment of the present invention.

FIG. 9 is a plan view of a movement mechanism provided under nonwoven fabric cloth rotation mechanism 111 shown in FIG. 8 for moving mopping portion 102. Referring to FIG. 9, the movement mechanism of mopping portion 102 includes wheel holder plate 113 connected to supporting portion 103 and four wheels 112*a* to 112*d* held by wheel holder plate 113. Note that the above described nonwoven fabric cloth rotation mechanism 111 is also held by wheel holder plate 113.

Wheel 112*a* serves as a measuring wheel for measuring the moving speed of floor cleaning apparatus 101*a*. Rotation of wheel 112*a* is detected by a measuring wheel encoder 129 through a speed measuring timing belt 128. Measuring wheel encoder 129 is provided on wheel holder plate 113.

Referring to FIG. 9, wheels 112*a* to 112*d* for movement are provided on both sides with nonwoven fabric cloth turntables 125*a* to 125*d* holding nonwoven fabric cloths 124 actually carrying out the mopping work interposed therebetween. Therefore, the floor can be cleaned stably.

Figure 10:
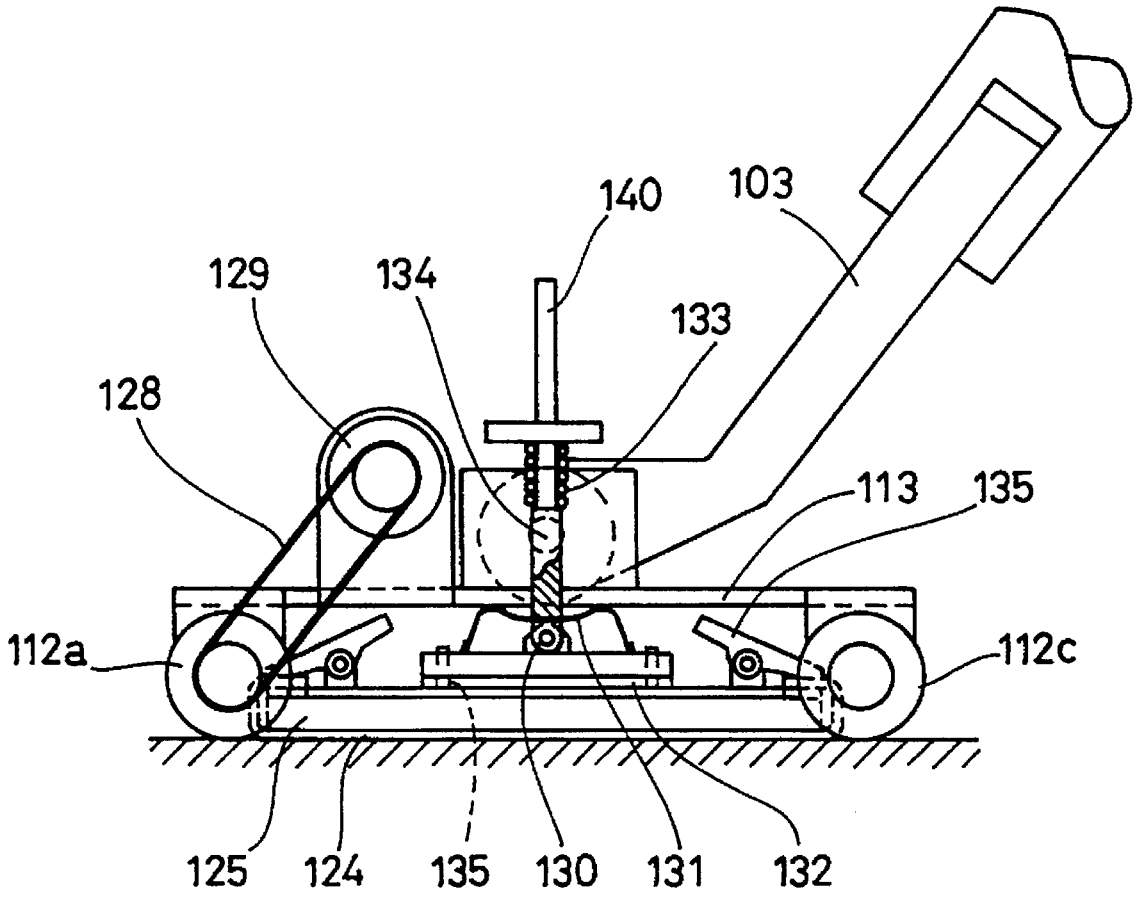
FIG. 10 is a side view of a mopping portion according to the second embodiment.

FIG. 10 is a diagram showing mopping portion 102 seen from side. Referring to FIG. 10, wheel holder plate 113 is connected to supporting portion 103 through a pivot center 134. A supporting member 140 of nonwoven fabric cloth turntable 125 is attached through a support, not shown, provided to wheel holder plate 113. Supporting member 140 supports nonwoven fabric cloth turntable 125 rockingly through a rocking center 130. Nonwoven fabric cloth turntable 125 is positioned by a pin 135 which positions attachment and detachment of nonwoven fabric cloth turntable 125, and supported by supporting member 140 with a turntable holding magnet 132. A leaf spring 131 for forcing nonwoven fabric cloth turntable 125 along the floor is provided between turntable holding magnet 132 and supporting member 140. Supporting member 140 is further provided with a compression spring 133 urging the nonwoven fabric cloth on the floor.

Figure 11:
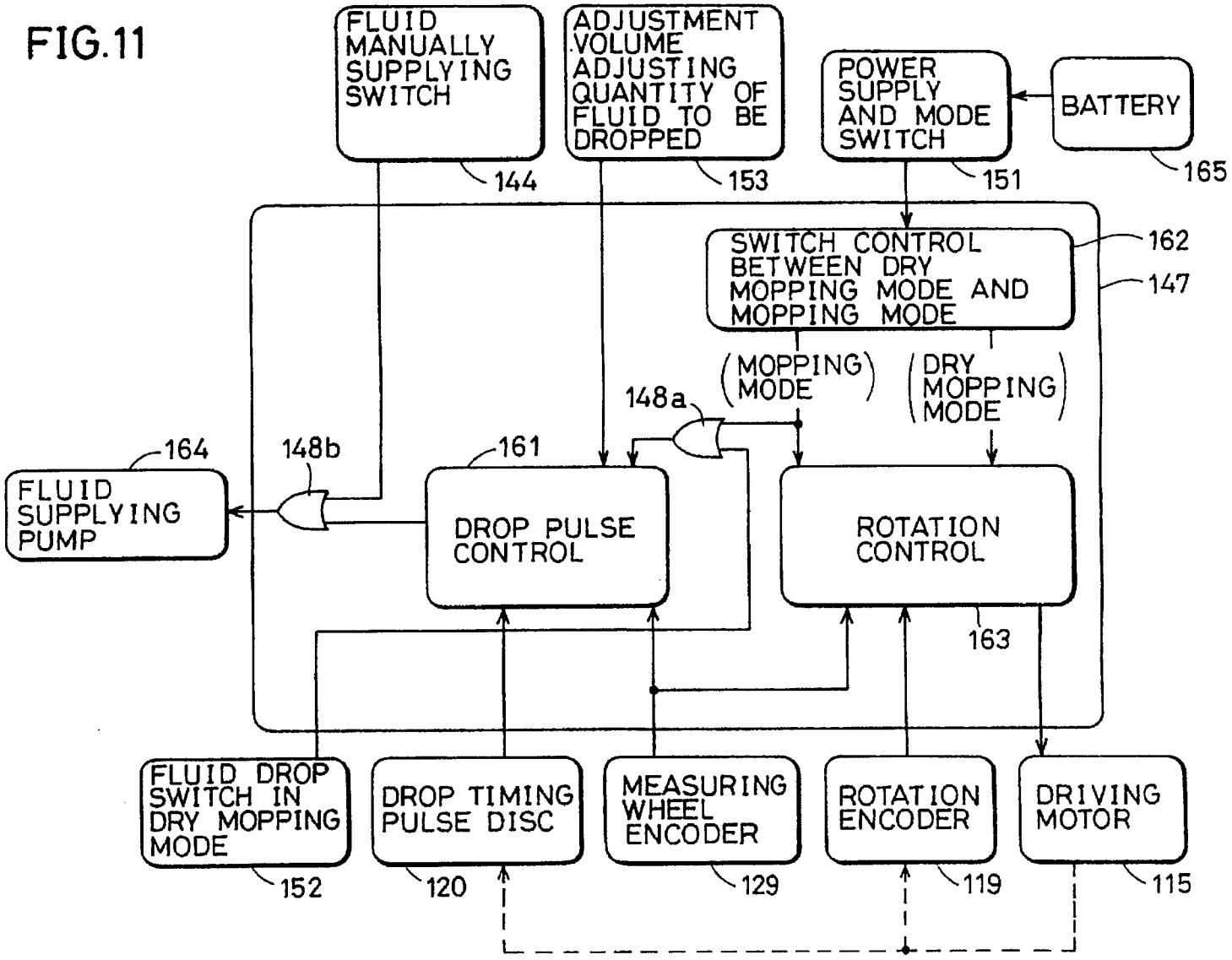
FIG. 11 is a block diagram of a control portion of the floor cleaning apparatus according to the present invention.

The control portion of floor cleaning apparatus 101*a* will be described. FIG. 11 is a schematic diagram for explaining the control content by a control portion 147 of floor cleaning apparatus 101*a* according to the second embodiment. Control portion 147 is provided in fluid supplying portion 143.

Referring to FIG. 11, control portion 147 includes a switch control circuit 162 connected to power supply and mode switch 151 and controlling switching between the dry mopping mode and the mopping mode, a rotation control circuit 163 connected to switch control circuit 162 and driving and controlling nonwoven fabric cloth turntable 125 according to respective modes, a drop pulse control circuit 161 receiving data on the quantity of the fluid dropped from adjustment volume 153, data on the moving speed of floor cleaning apparatus 101*a* from measuring wheel encoder 129, data on a drop timing from drop timing pulse disc 120, and the like and carrying out drop pulse control of the fluid, an OR circuit 148*a* connected to switch control circuit 162 and switch 152 in the dry mopping mode for transmitting signals dropping the fluid in either the dry mopping mode or the mopping mode to drop pulse control circuit 161, and an OR circuit 148*b* connected to fluid manually supplying switch 144 and drop pulse control circuit 161 for transmitting a pump drive signal to a fluid supplying pump 164 when any of the signals is on.

A signal from rotation control circuit 163 is applied to driving motor 115 for rotating nonwoven fabric cloth turntable 125. Driving motor 115 causes nonwoven fabric cloth turntables 125*a* to 125*d* to rotate through double-toothed timing belt 118. An operation signal associated with the rotation is transmitted to rotation encoder 119 and drop timing pulse disc 120. A signal from rotation encoder 119 is applied to rotation control circuit 163. A battery 165 is connected to power supply and mode switch 151.

In this embodiment, the floor cleaning apparatus is controlled so that a predetermined quantity of fluid per unit area is always dropped on the floor irrespective of the moving speed of mopping portion 102. In this case, the moving speed of mopping portion 102 is detected by measuring wheel encoder 129. Based on the detection result, drop pulse control circuit 161 controls the drop pulse so that the predetermined quantity of fluid per unit area is dropped.

Figure 12A:
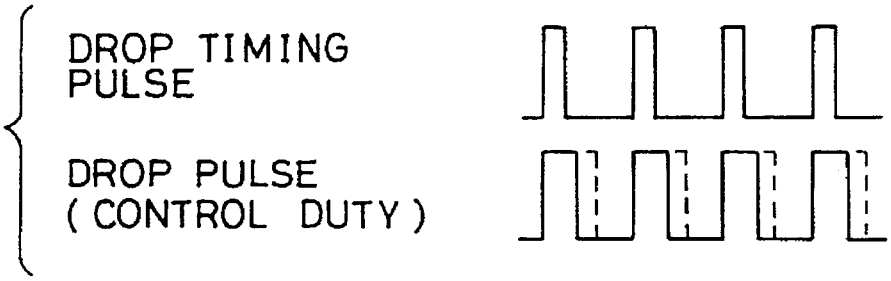
FIGS. 12A and 12B are diagrams showing the relationship between a fluid drop timing pulse and a drop pulse.
Figure 12B:
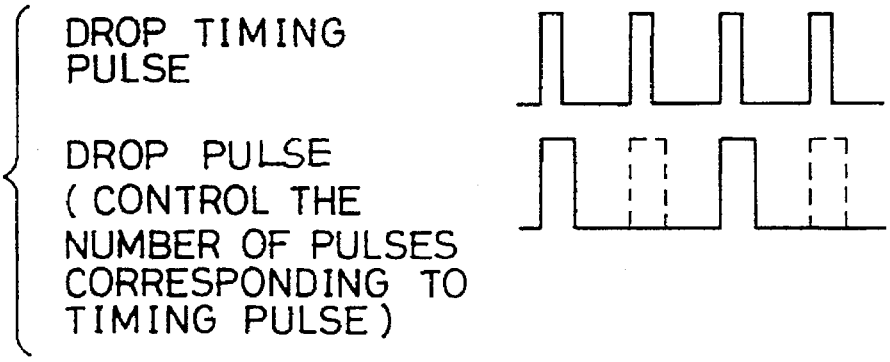

FIG. 12A shows an example of the drop pulse when the quantity of the fluid to be supplied from drop pulse control circuit 161 is controlledly adjustment volume 153 by controlling the duty of the drop pulse to the drop timing pulse. FIG. 12B shows an example of the drop pulse when the quantity of the fluid to be supplied is controlled by controlling the number of pulses to the timing pulse.

More specifically, under the control in a pulse manner, the quantity of the fluid to be dropped may be controlled according to the moving speed by controlling the pulse width with the pulse interval kept constant, or the quantity of the fluid to be dropped may be controlled according to the moving speed by controlling the pulse interval with the pulse width kept constant.

Figure 13:
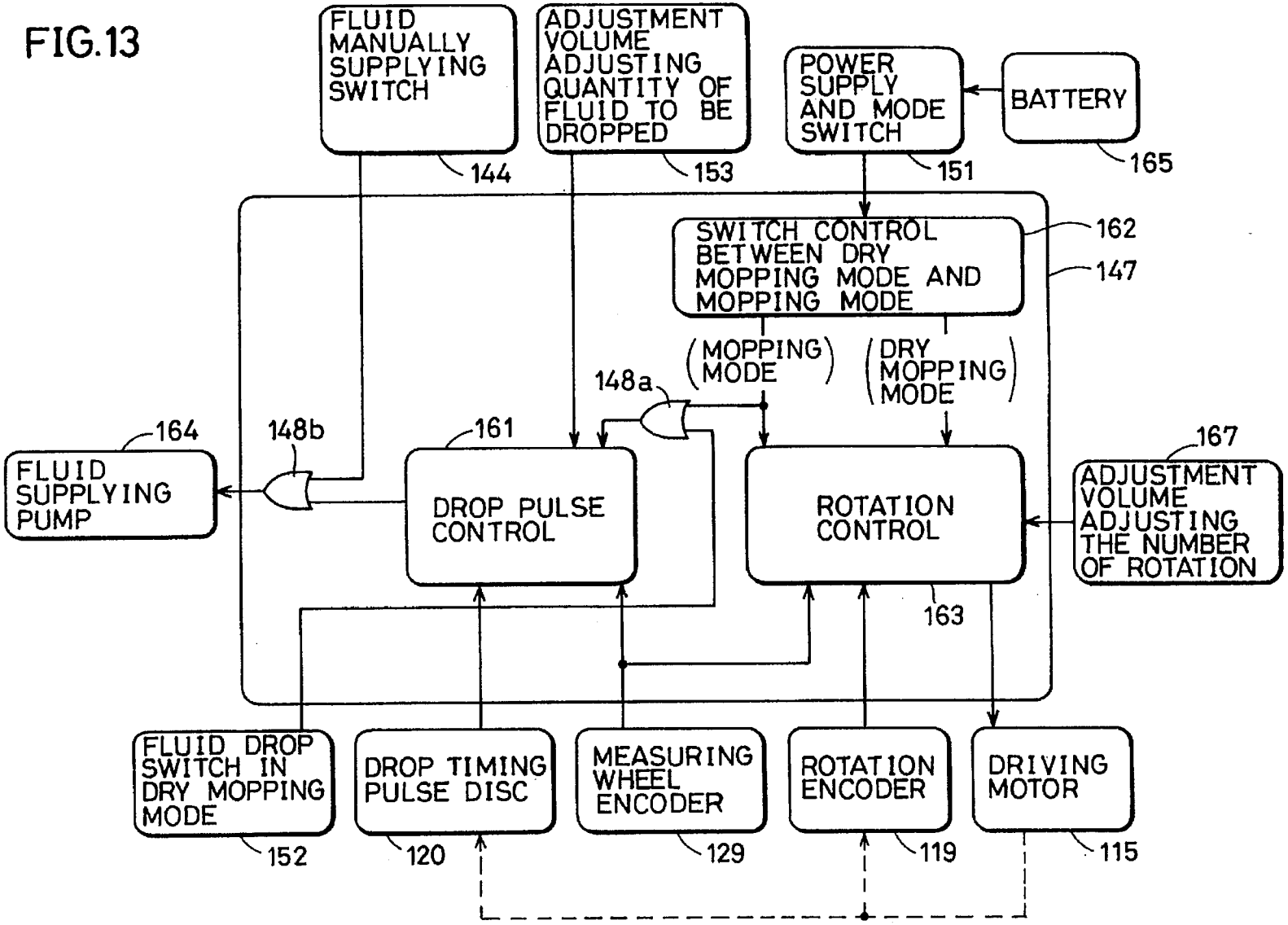
FIG. 13 is a block diagram showing another example of the control portion of the floor cleaning apparatus.

In the above embodiment, control was made so that a predetermined quantity of fluid per unit area is always to be dropped on the floor irrespectively of the moving speed of mopping portion 102. On the other hand, in addition to simply setting the quantity of the fluid to be dropped to a prescribed quantity by adjustment volume 153, control may be made so that the quantity of the fluid to be spread on the floor is constant. A block diagram of the control relationship in this case is shown in FIG. 13. This block diagram is approximately the same as that of FIG. 11. However, the block diagram of FIG. 13 is different from that of FIG. 11 in that a signal from measuring wheel encoder 129 is applied to rotation control circuit 163, and in that a signal from an adjustment volume 167 which adjusts the number of rotations of nonwoven fabric cloth turntable 125 is applied to rotation control circuit 163.

The quantity of the fluid to be dropped per unit area on the floor is controlled to be constant, and at the same time, the number of rotations of the rotating body is also controlled. Therefore, a predetermined quantity of the fluid is spread on the floor irrespective of the moving speed of mopping portion 102. As a result, nonuniform cleaning is prevented, making it possible to always carry out uniform cleaning irrespective of the moving speed of mopping portion 102. A method of controlling the quantity of the fluid to be dropped in this case is also as shown in FIG. 12.

Description will now be made on a drop timing pulse and a drive timing of fluid supplying pump 164 with reference to FIGS. 14A and 14B.

Because of the distance from fluid drop nozzle 127 to the floor, the fluid arrives at the floor after a predetermined time T since fluid supplying pump 164 is driven. Therefore, timing control must be made in order to drive fluid supplying pump 164 according to the moving speed of mopping portion 102.

Figure 14A:
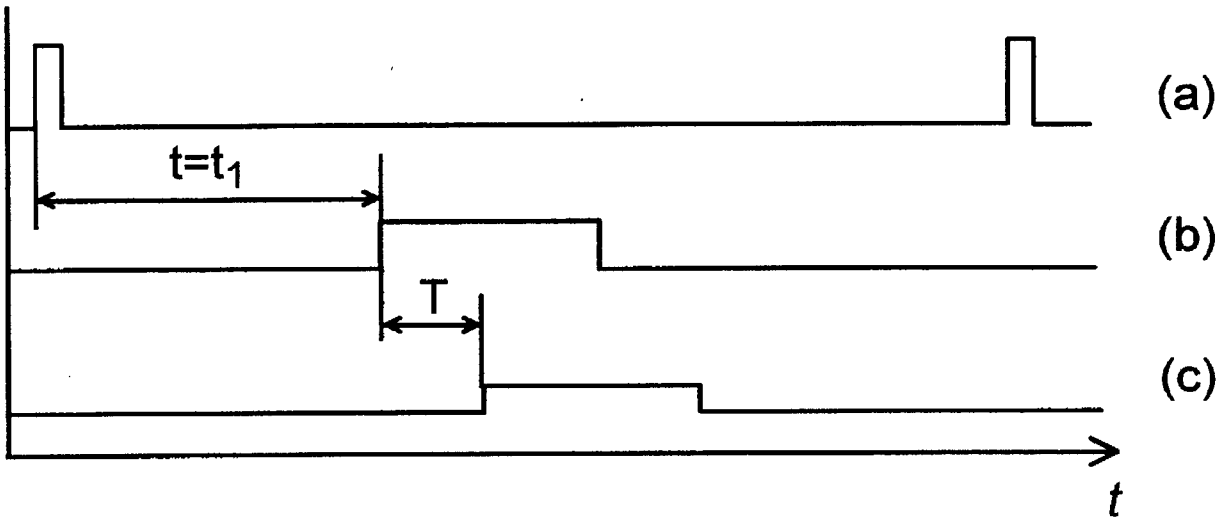
FIGS. 14A and 14B are timing charts showing timings of generation of drop timing pulses, a drive period of a fluid supply pump, and a drop period of the fluid.

FIG. 14A shows the fluid drop timing when the moving speed of mopping portion 102 is slow, and the rotation speed of nonwoven fabric cloth turntable 125 is controlled to be slow. FIG. 14B shows the fluid drop timing when the moving speed of mopping portion 102 is fast, and the rotation speed of nonwoven fabric cloth turntable 125 is controlled to be fast. In the figures, (a) shows the drop timing pulse. A timing pulse is generated every time nonwoven fabric cloth turntable 125 is rotated by 180°. In the figures, (b) shows a period during which fluid supplying pump 164 is driven, and (c) shows a period during which the fluid is actually dropped on the floor.

Referring to FIG. 14A, fluid supplying pump 164 starts to be driven a predetermined time t=t1 after generation of a drop timing pulse signal. A time T after that, the fluid is dropped on the floor through fluid drop nozzle 127.

On the other hand, when the moving speed of mopping portion 102 is fast, fluid supplying pump 164 starts to be driven a predetermined time t=t2 after generation of a drop timing pulse signal. Time T after that, the fluid is dropped on the floor through fluid drop nozzle 127.

Figure 14B:
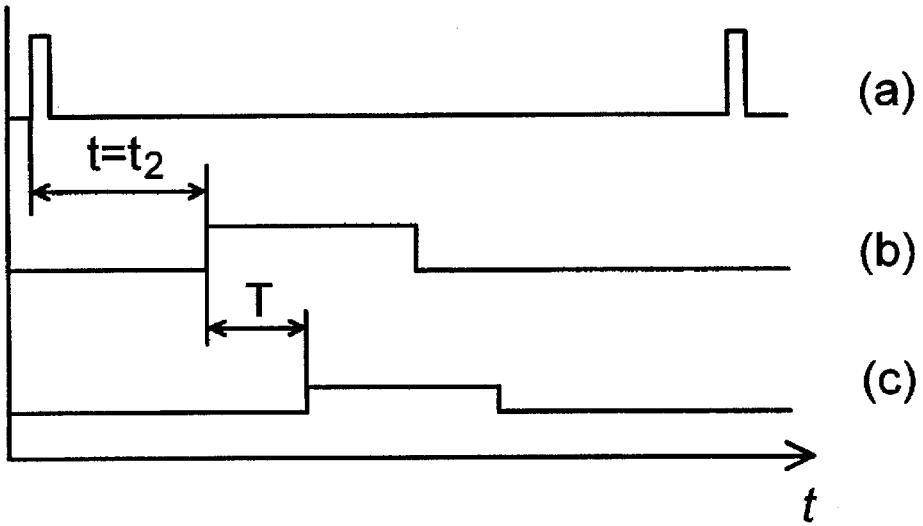

As shown in FIGS. 14A and 14B, operation of fluid supplying pump 164 is started a predetermined time corresponding to the rotation speed of nonwoven fabric cloth turntable 125 after generation of a drop timing pulse. Therefore, rotation of nonwoven fabric cloth turntable 125 and the drop timing are not synchronized even when the rotation speed of nonwoven fabric cloth turntable 125 is changed. By thus structured, even if the time at which a drop timing pulse is generated is deviated from rotation of the rotating body at the time of assembly, the deviation can be eliminated by adjusting the predetermined time.

Figure 15A:
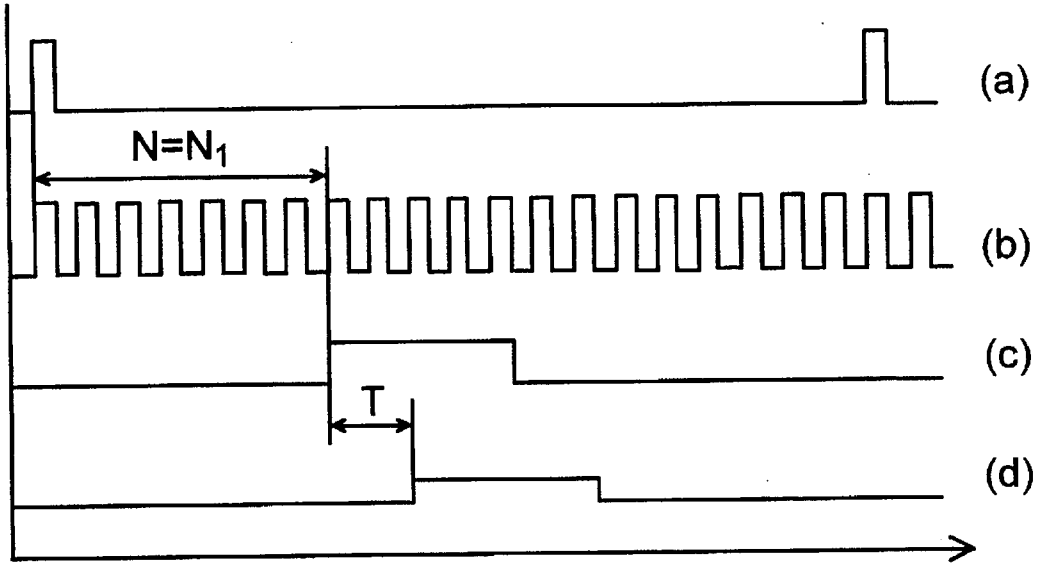
FIGS. 15A and 15B are timing charts showing respective timings of generation of drop timing pulses, a rotary encoder, the fluid supply pump, and the drop period of the fluid.
Figure 15B:
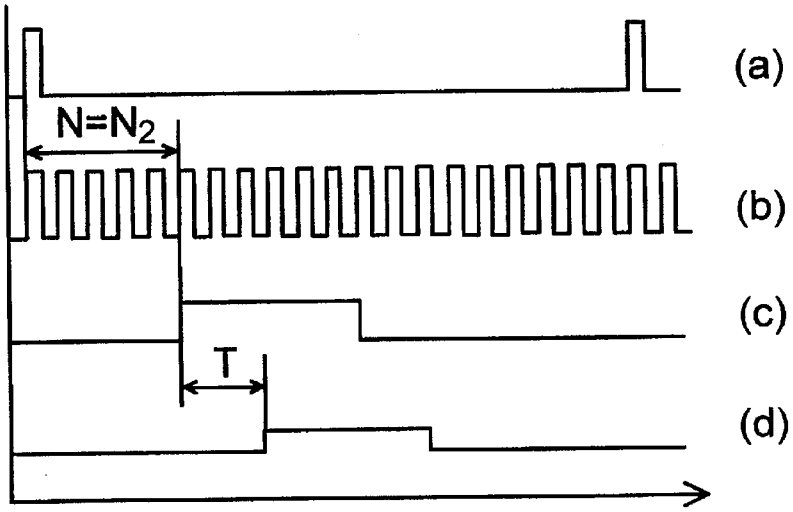

FIGS. 15A and 15B are timing charts when fluid supplying pump 164 is driven after rotation encoder 119 counts a predetermined number of pulses since generation of a drop timing pulse. FIG. 15A shows the case where the moving speed of mopping portion 102 is slow, and FIG. 15B shows the case where the moving speed of mopping portion 102 is fast. In the figures, (a) shows a drop timing pulse. Also in this case, assume that a timing pulse is generated every time nonwoven fabric cloth turntable 125 is rotated by 180°, similar to the case of FIGS. 14A and 14B. In the figures, (b) shows a timing pulse of rotation encoder 119. (c) shows a period during which fluid supplying pump 164 is driven, and (d) shows a period during which the fluid is actually dropped on the floor.

Referring to FIG. 15A, fluid supplying pump 164 starts to be driven when rotation encoder 119 counts a predetermined number of pulses N=N1 after generation of a drop timing pulse signal. Time T after that, the fluid is dropped on the floor through fluid drop nozzle 127.

When the moving speed of mopping portion 102 is fast, fluid supplying pump 164 starts to be driven when rotation encoder 119 counts a predetermined number of pulses N=N2 after generation of a drop timing pulse signal. Time T after that, the fluid is dropped on the floor through fluid drop nozzle 127.

As shown in FIGS. 15A and 15B, operation of fluid supplying pump 164 is started when rotation encoder 119 counts a predetermined number of pulses corresponding to the rotation speed of nonwoven fabric cloth turntable 125 after generation of a drop timing pulse. Therefore, the problem in the case of FIG. 14 can be eliminated by adjusting the number of pulses which rotation encoder 119 counts.

Figure 16:
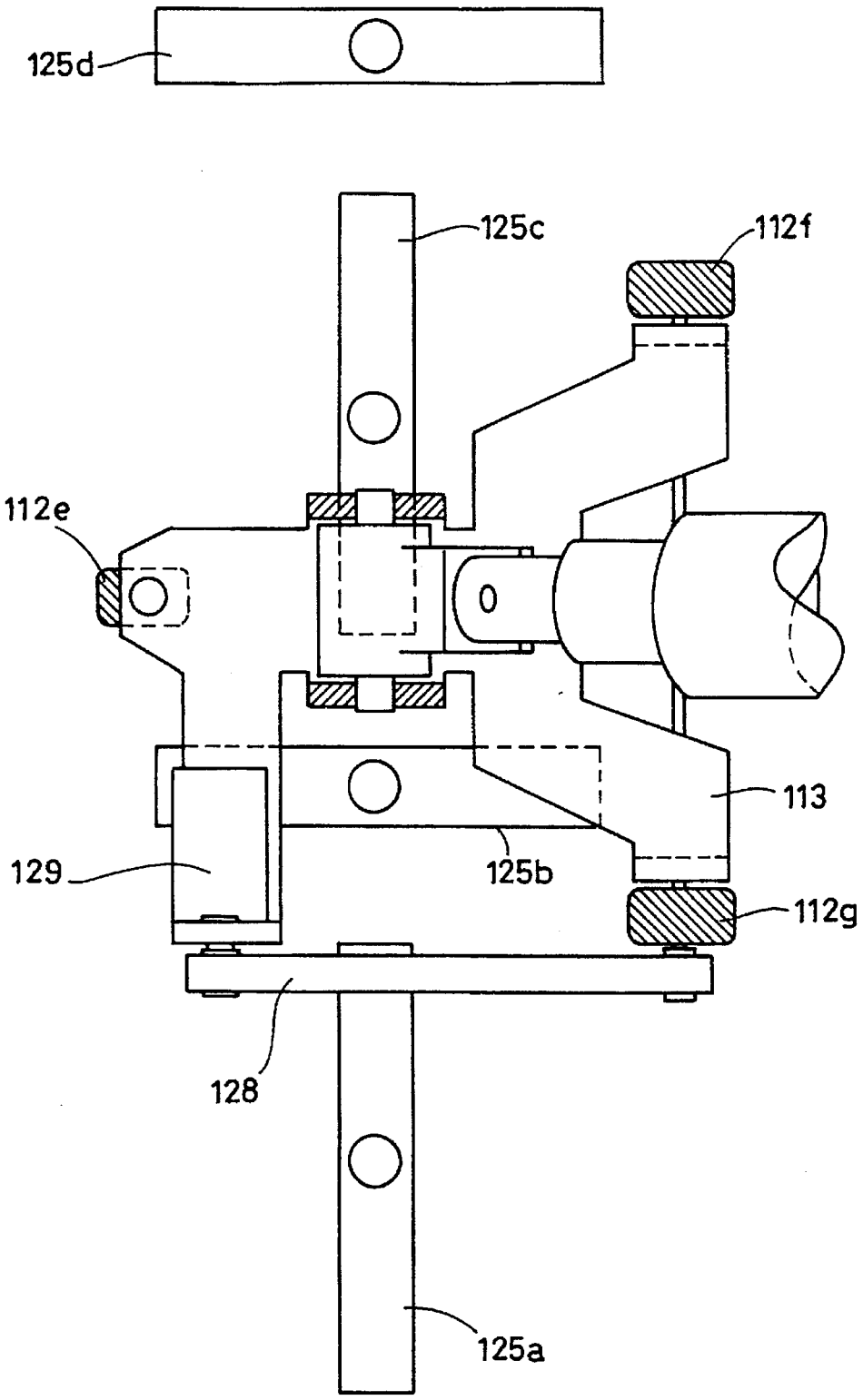
FIG. 16 is a plan view of the mopping portion according to a modification of the second embodiment.
Figure 17:
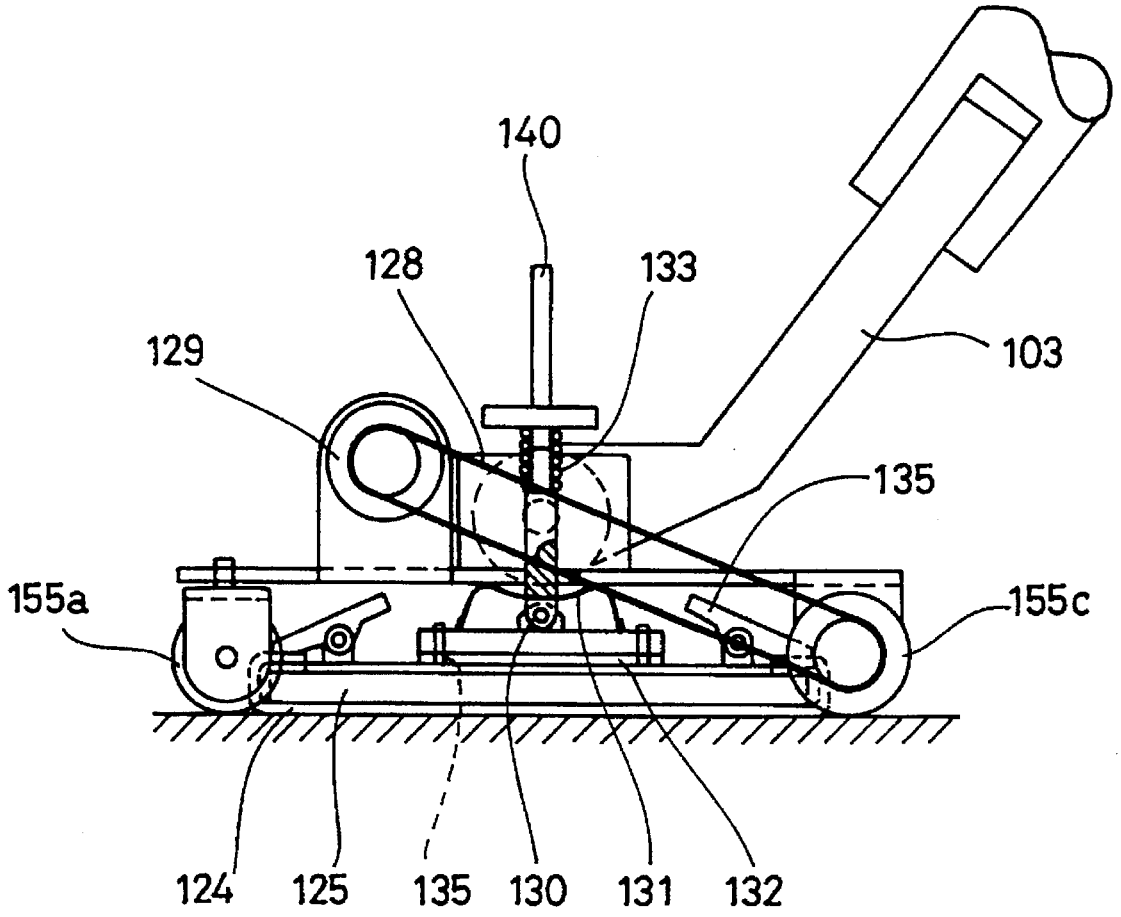
FIG. 17 is a plan view of the mopping portion according to another modification of the second embodiment.

FIGS. 16 and 17 are a plan view and a side view showing a modification of mopping portion 102 of floor cleaning apparatus 101*a* according to the second embodiment. These figures correspond to FIGS. 9 and 10, respectively. Referring to FIGS. 16 and 17, mopping portion 102 according to this modification is approximately the same as that of the second embodiment shown in FIG. 9. However, this modification is different from the second embodiment shown in FIGS. 9 and 10 in that three wheels are provided. One of the wheels provided on the front side serves as an adjustable caster wheel, and a measuring wheel is attached to a wheel 112*g* on the rear side. Other than that, this modification is the same as the second embodiment. The same or corresponding portions are labeled with the same reference characters, and the description thereof will not be repeated.

Referring to FIGS. 16 and 17, in this modification, the movement direction of mopping portion 102 can be changed more easily than the case of the second embodiment by a wheel 112*e* on the front side functioning as an adjustable caster wheel.

In the above modification, only wheel 112*e* on the front side out of the three wheels was an adjustable caster wheel. However, all of three wheels 112*e* to 112*g* may be adjustable caster wheels. In this case, the movement direction can be changed more easily.

In this modification, the wheel on the front side was an adjustable caster wheel, and the wheel on the rear side was a measuring wheel. However, it is needless to say that the wheels may be provided oppositely.

(3) Third Embodiment

In the second embodiment, wheels 112 were provided in front of and behind mopping portion 102. In the third embodiment, wheels 112 are provided behind mopping portion 102 similar to the case of the first embodiment. By cleaning the floor while pulling mopping portion 102 backward, wheels 112 do not pass on the cleaned floor.

Figure 18:
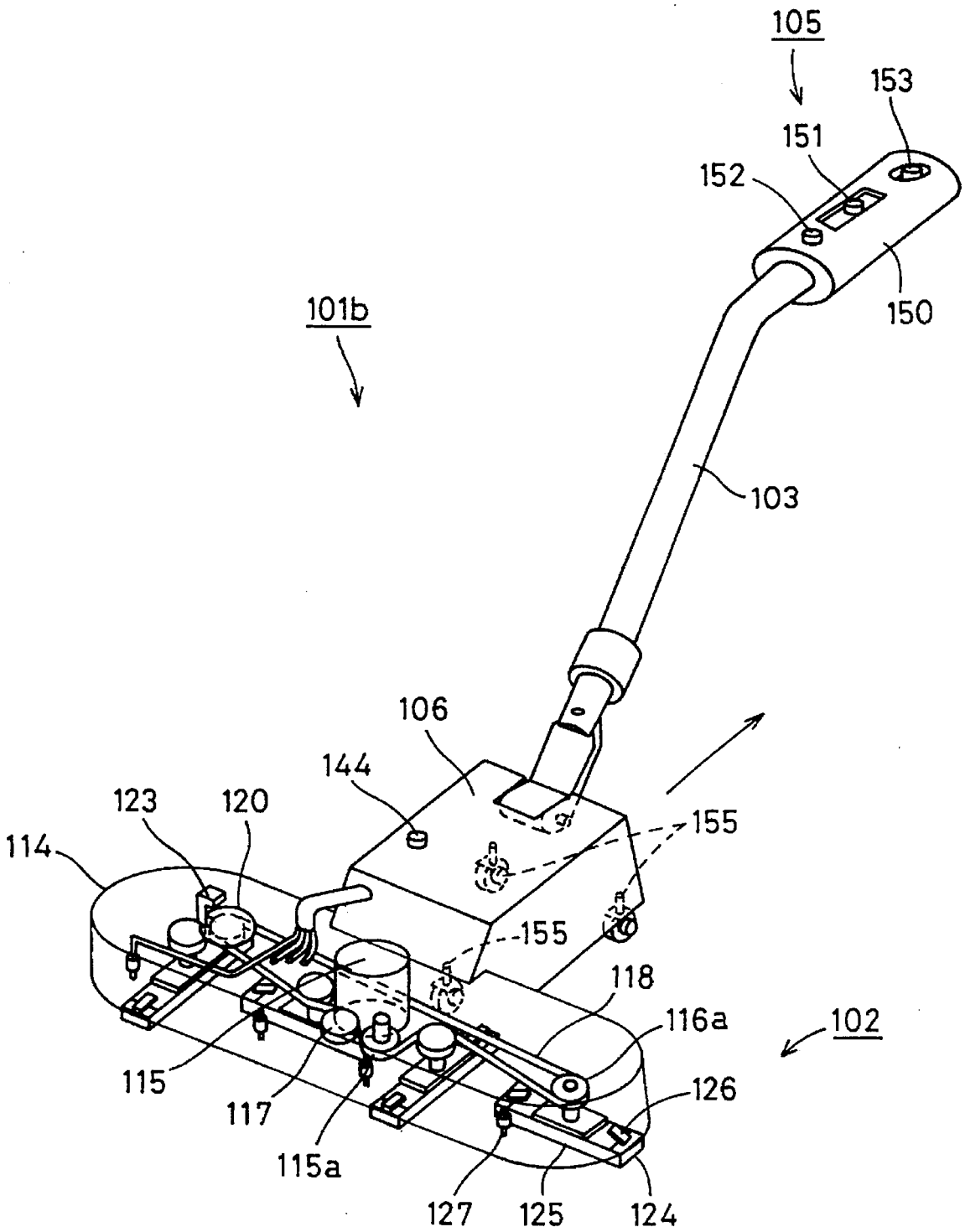
FIG. 18 is a schematic diagram showing the entire structure of a floor cleaning apparatus according to a third embodiment of the present invention.

FIG. 18 is a perspective view schematically showing the structure of a floor cleaning apparatus 101*b* according to the third embodiment.

Referring to FIG. 18, floor cleaning apparatus 101*b* according to the third embodiment includes mopping portion 102, a body portion 106 supporting mopping portion 102 and provided with wheels, and grip portion 105 connected to body portion 106. In the third embodiment, the direction indicated by an arrow is the basic cleaning direction, so that wheels 112 do not pass on the floor which has been cleaned. Since the details of mopping portion 102 and grip portion 105 are the same as those of the second embodiment, the same or corresponding portions are labeled with the same reference characters, and the description thereof will not be repeated.

In the third embodiment, body portion 106 is provided instead of fluid holding portion 104 of the second embodiment. Body portion 106 includes fluid tank 141, fluid supplying portion 143, and fluid manually supplying switch 144. Referring to FIG. 18, the wheels are adjustable caster wheels 155. By all the wheels functioning as adjustable caster wheels 155, mopping portion 102 can move right and left smoothly. In FIG. 18, one wheel is provided on the side of mopping portion 102, and two wheels are provided on the side of grip portion 105. Conversely, two wheels may be provided on the side of mopping portion 102, and one wheel may be provided on the side grip portion 105. Further, two wheels may be provided on both sides, and the floor cleaning apparatus may include four wheels in total.

By all the wheels functioning as adjustable caster wheels as described above, mopping portion 102 can move smoothly not only back and forth but also right and left. Therefore, one can carry out the cleaning work as if one carries out the conventional mopping work.

Figure 19:
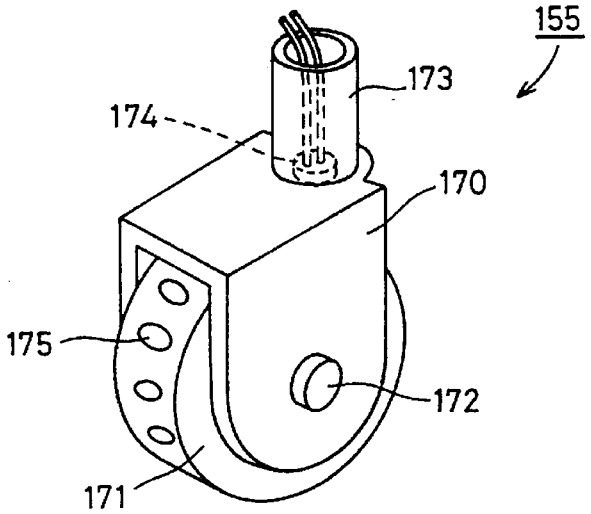
FIG. 19 is a diagram showing the structure of a portion of detecting a rotation speed of an adjustable caster wheel.

FIG. 19 is a perspective view schematically showing a rotation speed detecting portion 156 detecting the running speed of floor cleaning apparatus 101*b* when adjustable caster wheels 155 are used. Referring to FIG. 19, adjustable caster wheel 155 includes a wheel holding portion 170 attached to body portion 106, and a wheel rotation axis 172 held by wheel holding portion 170 and holding a measuring wheel 171 rotatably. Wheel holding portion 170 is connected to the body through a movement direction rotation axis 173. Measuring wheel 171 is provided with one permanent magnet 175 or permanent magnets 175. By a Hall element 174 detecting the magnetism, the rotation speed of measuring wheel 171 is detected. Movement direction rotation axis 173 of measuring wheel 171 extends in the perpendicular direction without crossing wheel rotation axis 172, as shown in the figure.

Since Hall element 174 is provided so as to face the wheel approximately above the rotation axis of measuring wheel 171, measuring wheel 171 and Hall element 174 always keep a predetermined positional relationship even if measuring wheel 171 rotates around movement direction rotation axis 173.

By thus structured, the running speed can be detected even with adjustable caster wheels 155. Further, the running speed can be detected with a simple structure.

Figure 20:
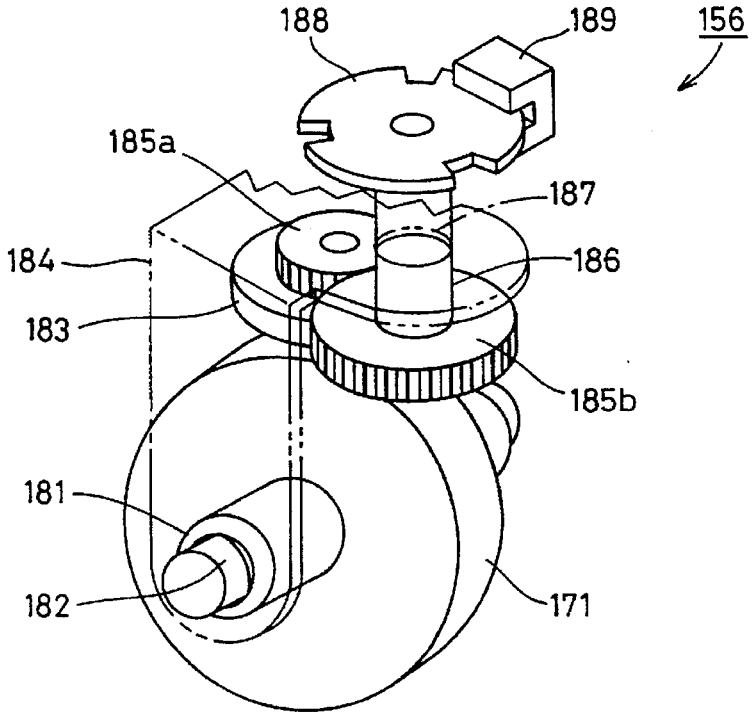
FIG. 20 is a perspective view showing another example of the portion of detecting a rotation speed of the adjustable caster wheel.

FIG. 20 is a perspective view showing another example of rotation speed detecting portion 156 using adjustable caster wheel 155. Referring to FIG. 20, measuring wheel 171 is supported by a wheel rotation axis 182 through a wheel bearing 181, and wheel rotation axis 182 is connected to body portion 106 through a frame 184 and a movement direction rotation axis 186, in this embodiment. Rotation speed detecting portion 156 includes a turntable 183 frictionally coupled to the circumferential surface of measuring wheel 171, a gear 185*a* coaxial with turntable 183, a gear 185*b* engaged with gear 185*a*, movement direction rotation axis 186 rotating coaxially with gear 185*b*, a pulse disc 188, and a photointerrupter 189 detecting notch portions of pulse disc 188. Movement direction rotation axis 186 is supported by frame 184 through a movement direction rotation bearing 187.

Turntable 183 is frictionally coupled to the circumferential surface of measuring wheel 171, and the rotation thereof is coupled to pulse disc 188 through gears 185*a* and 185*b*. The rotation of pulse disc 188 is detected by photointerrupter 189, and the rotation speed of the wheel is detected.

The rotation axis of pulse disc 188 also serves as movement direction rotation axis 186 of measuring wheel 171. Therefore, even when floor cleaning apparatus 101*b* changes the movement direction without rotation of measuring wheel 171, pulse disc 188 rotates. As a result, the effect of continuous fluid drop control is obtained.

Figure 21:
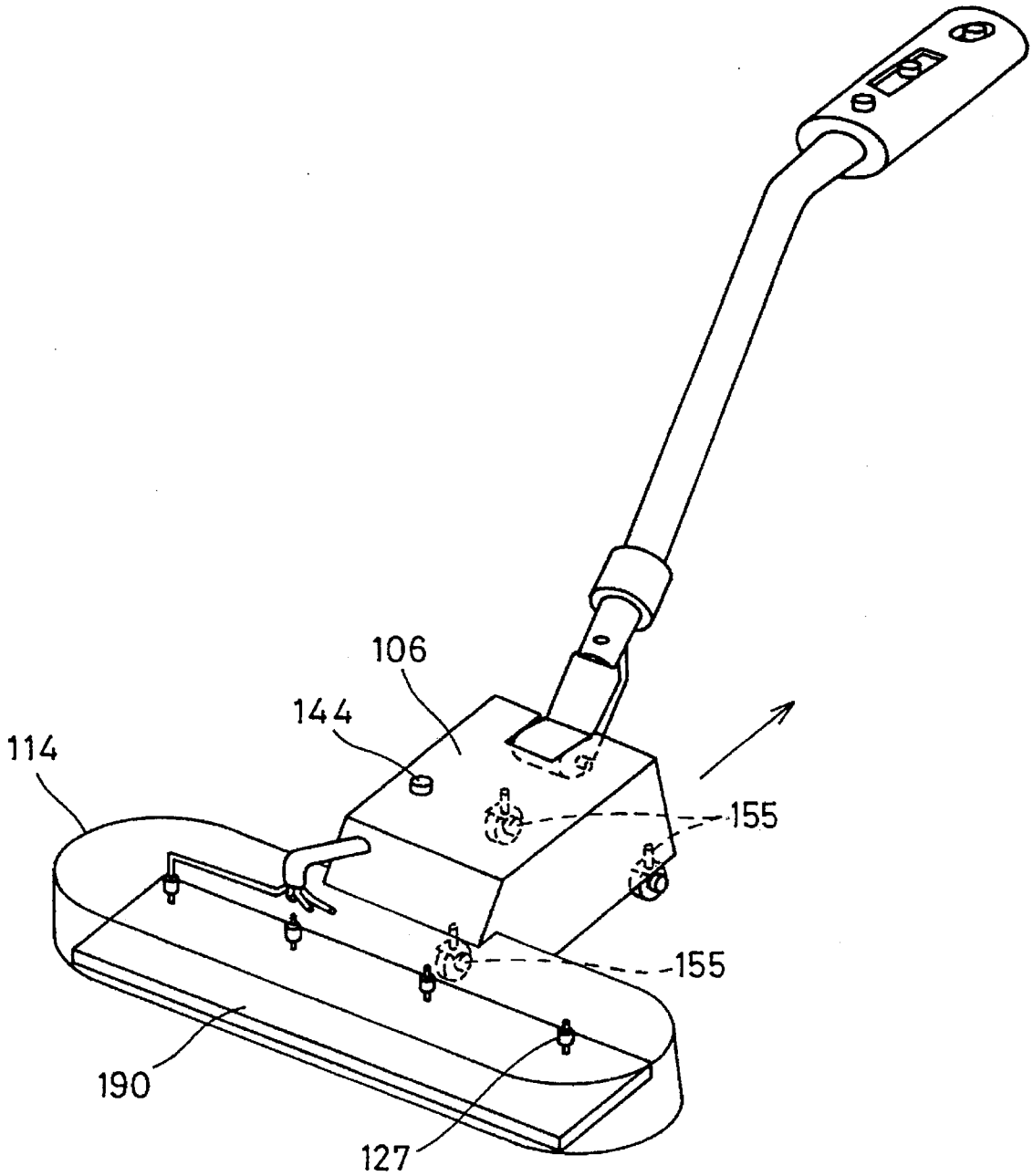
FIG. 21 is a diagram showing a modification of the third embodiment.

FIG. 21 is a diagram showing a modification of mopping portion 102 of the third embodiment. In this modification, as a portion of mopping portion 102 which actually cleans the floor, not a rotating nonwoven fabric cloth but a rectangular nonwoven fabric cloth pad 190 which does not rotate is used. Also in this case, a plurality of, for example, four fluid drop nozzles 127 are provided similar to the above embodiment. By providing nonwoven fabric cloth 124 in a fixed manner without rotating the same, the structure of mopping portion 102 can be simplified. Note that detection of the rotation speed of the wheel by measuring wheel 171, and the like are similar to those of the above embodiment also in this modification.

In this modification, it is not necessary to directly drop the fluid on the floor. Therefore, adjustment of the drop timing is not required.

Figure 22:
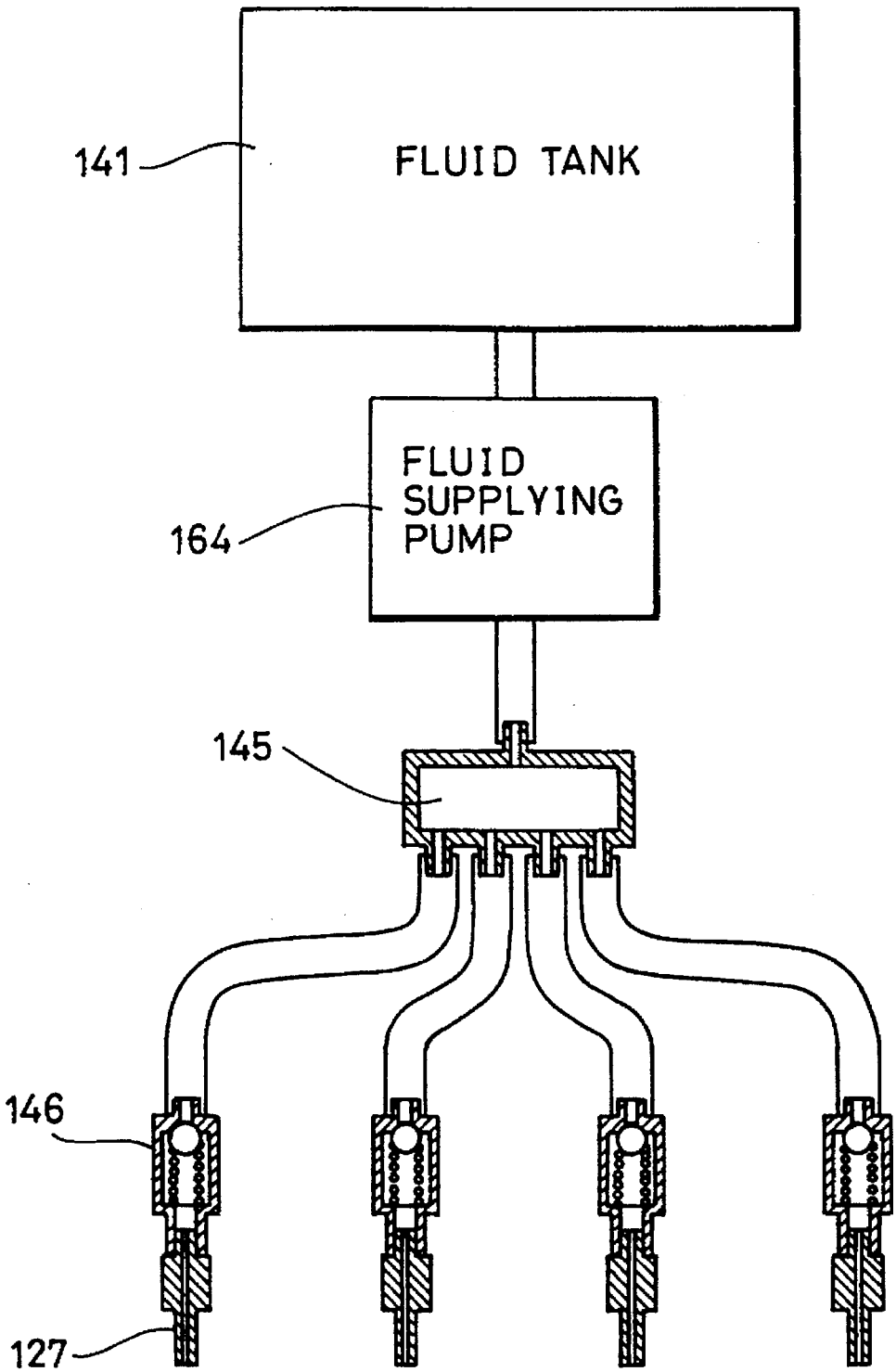
FIG. 22 is a diagram showing a path through which the fluid is fed.

FIG. 22 is a schematic view showing the structure of fluid supplying portion 143. Referring to FIG. 22, fluid supplying portion 143 includes fluid tank 141, fluid supplying pump 164 connected to fluid tank 141, a distributor 145 connected to fluid supplying pump 164, and a plurality of fluid drop nozzles 127 connected to distributor 145. A check valve 146 preventing the reflux of the fluid from the side of fluid drop nozzle 127 to the side of distributor 145 is provided between each fluid drop nozzle 127 and distributor 145. Provision of check valve 146 ensures stop of drop of the fluid from each fluid drop nozzle 127 simultaneously with stop of fluid supplying pump 164. If such check valve 146 is not provided, even if fluid supplying pump 164 is stopped in order to stop dropping the fluid, a difference in level of fluid between fluid supplying pump 164 and respective fluid drop nozzles 127 causes the air to enter through fluid drop nozzle 127 having a larger difference, and causes the fluid which is trapped between fluid supplying pump 164 and each fluid drop nozzle 127 to drop through fluid drop nozzle 127 having a smaller difference. Such a problem can be eliminated by provision of check valve 146.

Figure 23A:
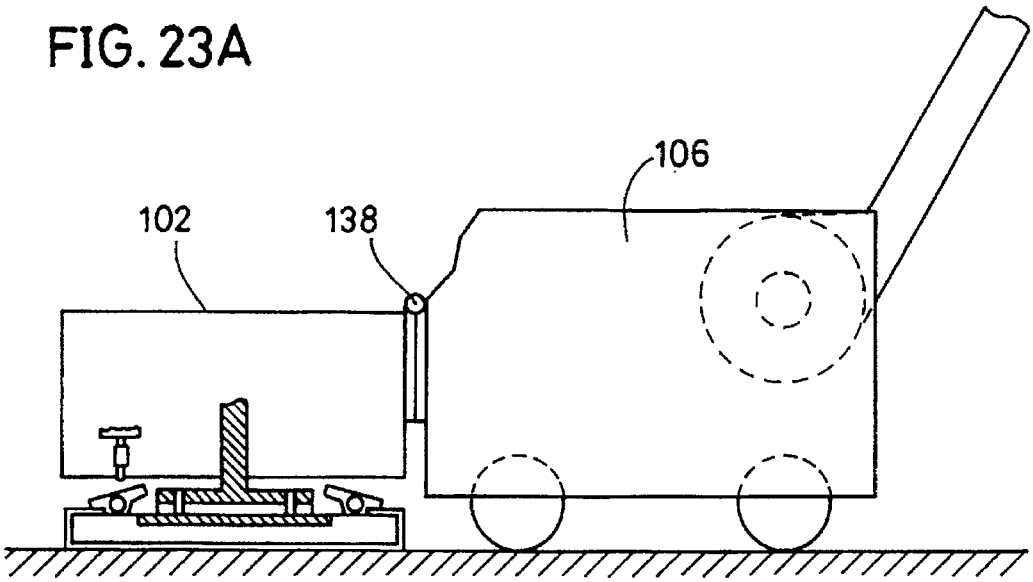
FIGS. 23A and 23B are diagrams showing a state in which consumables of the floor cleaning apparatus according to the present invention are exchanged.
Figure 23B:
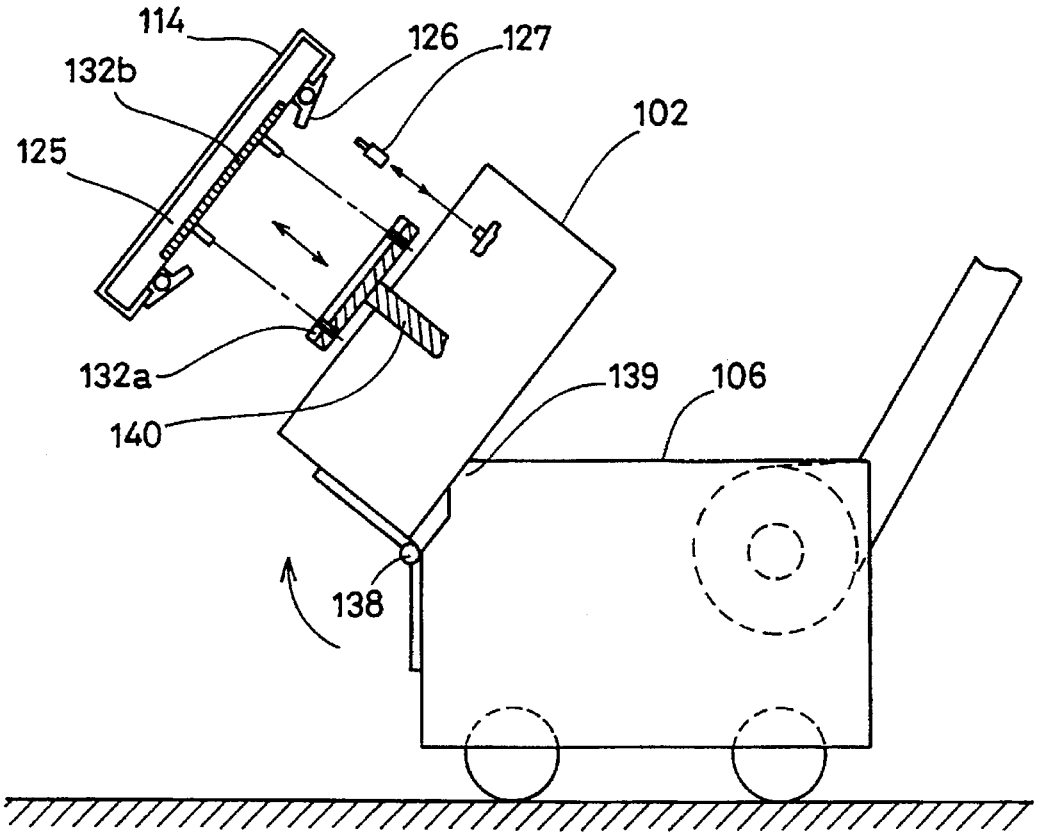

Description will now be given of a method of exchanging consumables used in floor cleaning apparatus 101*b* according to the third embodiment of the present invention. FIG. 23A is a diagram showing the floor cleaning apparatus when it carries out the mopping work, and FIG. 23B is a diagram showing the floor cleaning apparatus when consumables used therein are exchanged. In floor cleaning apparatus 101*b*, it is necessary to exchange consumables such as nonwoven fabric cloth turntable 125 and fluid drop nozzle 127. Therefore, in floor cleaning apparatus 101*b*, body portion 106 and mopping portion 102 are connected by a hinge 138 as shown in FIGS. 23A and 23B. When mopping portion 102 is rotated in the direction indicated by an arrow using hinge 138, mopping portion 102 is held by a stopper 139 provided to body portion 106. In such a state, nonwoven fabric cloth turntable 125 is detached from supporting member 140. By operating nonwoven fabric cloth clip 126, nonwoven fabric cloth 114 is exchanged for a new one. Since nonwoven fabric cloth turntable 125 is coupled to supporting member 140 by turntable holding magnet 132 including a magnet plate 132*a* and a magnetic plate 132*b*, nonwoven fabric cloth turntable 125 can be easily detached from supporting member 140.

In the above description of the method of exchanging consumables, floor cleaning apparatus 101*b* according to the third embodiment was taken as an example. However, this method can be applied similarly to floor cleaning apparatus 101*a* according to the first and second embodiments. Although nonwoven fabric cloth 124 is held by nonwoven fabric cloth turntable 125 with nonwoven fabric cloth clip 126, nonwoven fabric cloth 124 may be held by nonwoven fabric cloth turntable 125 with Velcro or the like.

As described above, when attaching mopping portion 102 to body portion 106 through hinge 138, consumables can be exchanged easily.

(4) Fourth Embodiment

The fourth embodiment of the present invention will now be described. In the fourth embodiment, when the floor cleaning apparatus according to the second and third embodiments moves forward, a wheel or wheels on the forward side comes in contact with the floor, and a wheel or wheels on the backward side comes apart from the floor. When the apparatus moves backward, a wheel or wheels on the backward side comes in contact with the floor, and a wheel or wheels on the forward side comes apart from the floor. Further, in the fourth embodiment, mode switching of the second and third embodiments is not carried out.

As a result, the wheel or wheels does not pass on the floor which has been cleaned. Therefore, the operator can carry out the cleaning work without making dirty the floor which has been cleaned by the wheel or wheels.

This apparatus is mainly used in floor cleaning in hospital, an office, school, a factory, and the like, in which a mop or autonomously running cleaning robot is used. By using this apparatus, the operator can clean the floor including every corner of the floor uniformly as if he mops the floor. It was not achieved by using a conventional apparatus.

The fourth embodiment is different from the second and third embodiments only in the above portion. Nonwoven fabric cloth rotation mechanism 111 and the like of the fourth embodiment are the same as those of the third embodiment. The same or corresponding portions are labeled with the same reference characters, and the description thereof will not be repeated.

Figure 24:
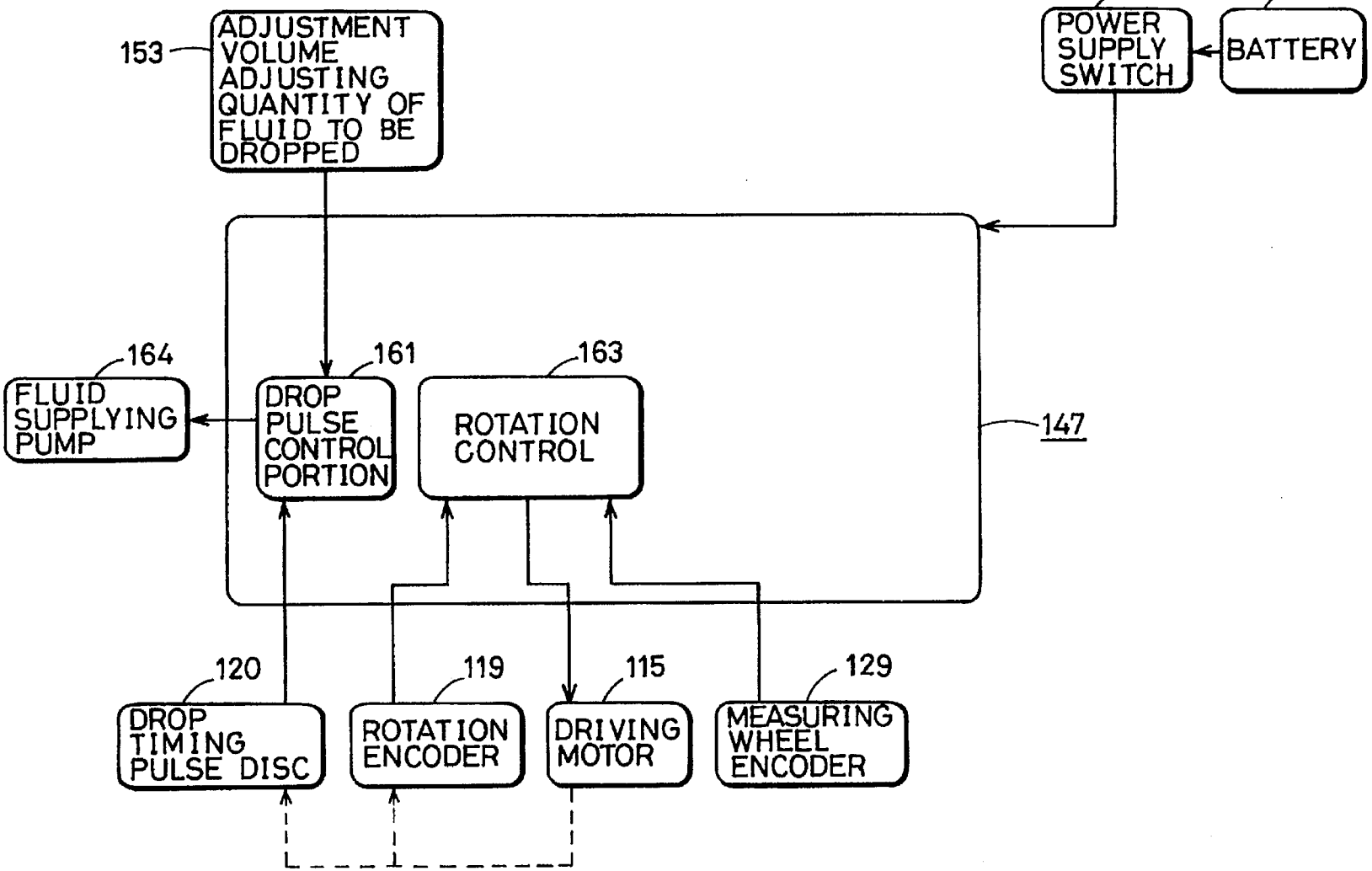
FIG. 24 is a block diagram showing the structure of a floor cleaning apparatus according to a fourth embodiment of the present invention.

FIG. 24 is a block diagram showing the structure of a floor cleaning apparatus according to the fourth embodiment of the present invention.

Referring to FIG. 24, the floor cleaning apparatus includes control portion 147 controlling the entire apparatus, measuring wheel encoder 129 coupled to forward and backward measuring wheels and measuring the number of rotations of the measuring wheels, driving motor 115 rotating the nonwoven fabric cloth turntable (rotating body) at a speed based on the number of rotations of measuring wheel encoder 129, rotation encoder 119 measuring the number of rotations of the nonwoven fabric cloth turntable, drop timing pulse disc 120 rotating along with rotation of the nonwoven fabric cloth turntable, fluid supplying pump 164 dropping the fluid on the floor through the fluid drop nozzle, adjustment volume 153 adjusting the quantity of the fluid to be dropped, battery 165, and power supply switch 151.

Control portion 147 includes drop pulse control portion 161 generating a pulse which is a drop timing of the fluid to fluid supplying pump 164 based on signals from drop timing pulse disc 120 and adjustment volume 153, and rotation control portion 163 controlling driving motor 115 based on signals from measuring wheel encoder 129 and rotation encoder 119.

Specifically, rotation control portion 163 controls driving motor 115, so that the rotation speed of the nonwoven fabric cloth turntable changes in proportion to the rotation speed of the measuring wheels. As a result, the rotation speed of the nonwoven fabric cloth turntable increases as the moving speed of the floor cleaning apparatus increases. Even if the moving speed of the floor cleaning apparatus changes, the operator can always carry out the cleaning work under the same condition.

Battery 165 supplies current to control portion 147 through power supply switch 151.

Figure 25:
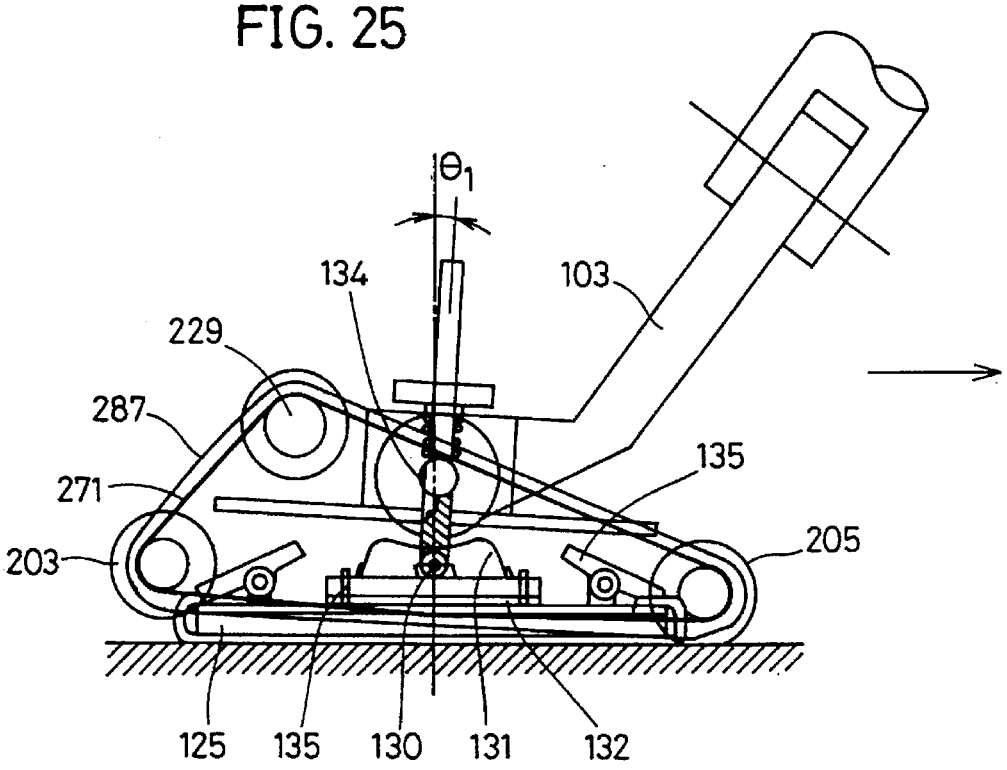
FIG. 25 is a side view showing a state in which the floor cleaning apparatus according to the fourth embodiment moves backward.
Figure 26:
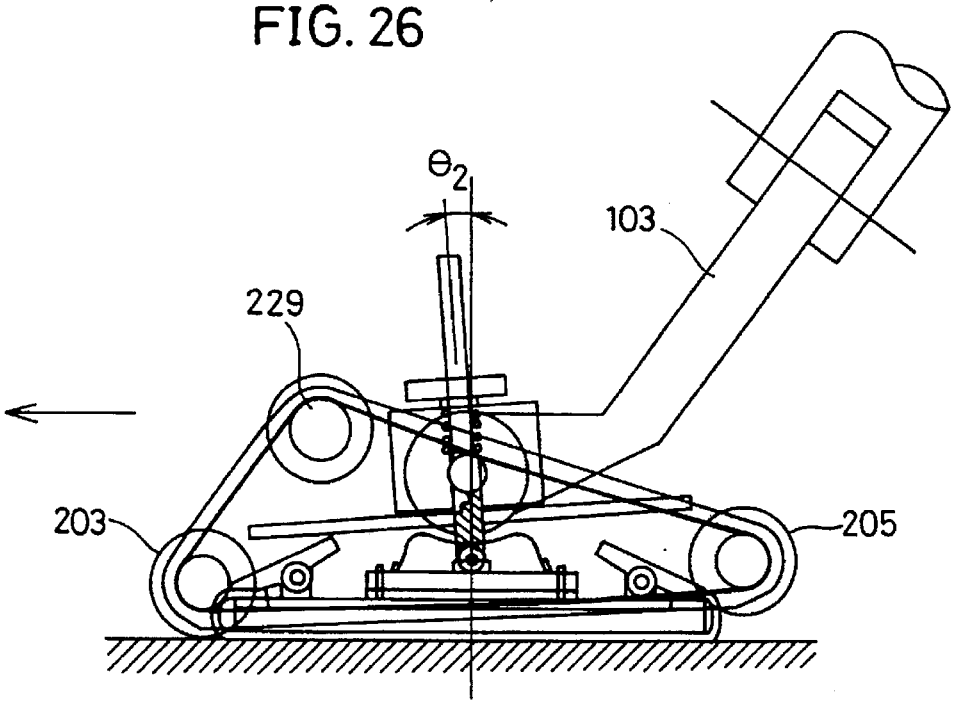
FIG. 26 is a side view showing a state in which the floor cleaning apparatus according to the fourth embodiment moves forward.

FIG. 25 is a side view showing the state where the floor cleaning apparatus according to the fourth embodiment moves backward. FIG. 26 is a side view showing the state where the floor cleaning apparatus according to the fourth embodiment moves forward.

Referring to FIG. 25, a forward measuring wheel 203, a backward measuring wheel 205, and measuring wheel encoder 229 are engaged with a rocking plate 287. Rocking plate 287 is engaged with supporting portion 103 through pivot center 134. Rocking plate 287 turns with rocking center 130 as the axis center. Therefore, as shown in FIG. 25, the operator pulls supporting portion 103 in the direction indicated by an arrow in order to move the floor cleaning apparatus backward, causing rocking plate 287 to turn clockwise by an angle of $\theta_1$ from its neutral position. As a result, forward measuring wheel 203 comes apart from the floor, and backward measuring wheel 205 comes in contact with the floor. Because of friction between backward measuring wheel 205 and the floor, backward measuring wheel 205 rotates with backward movement of the apparatus. Rotation of backward measuring wheel 205 is transmitted to measuring wheel encoder 229 through a speed measuring timing belt 271 bridged among forward measuring wheel 203, backward measuring wheel 205, and measuring wheel encoder 229.

On the other hand, as shown in FIG. 26, the operator pushes supporting portion 103 in the direction indicated by an arrow in order to move the floor cleaning apparatus forward, causing rocking plate 287 to turn counterclockwise by an angle of $\theta_2$ from its neutral position. As a result, forward measuring wheel 203 comes in contact with the floor, and backward measuring wheel 205 comes apart from the floor. Rotation of forward measuring wheel 203 is transmitted to measuring wheel encoder 229.

(5) Other Embodiments

Figure 27:
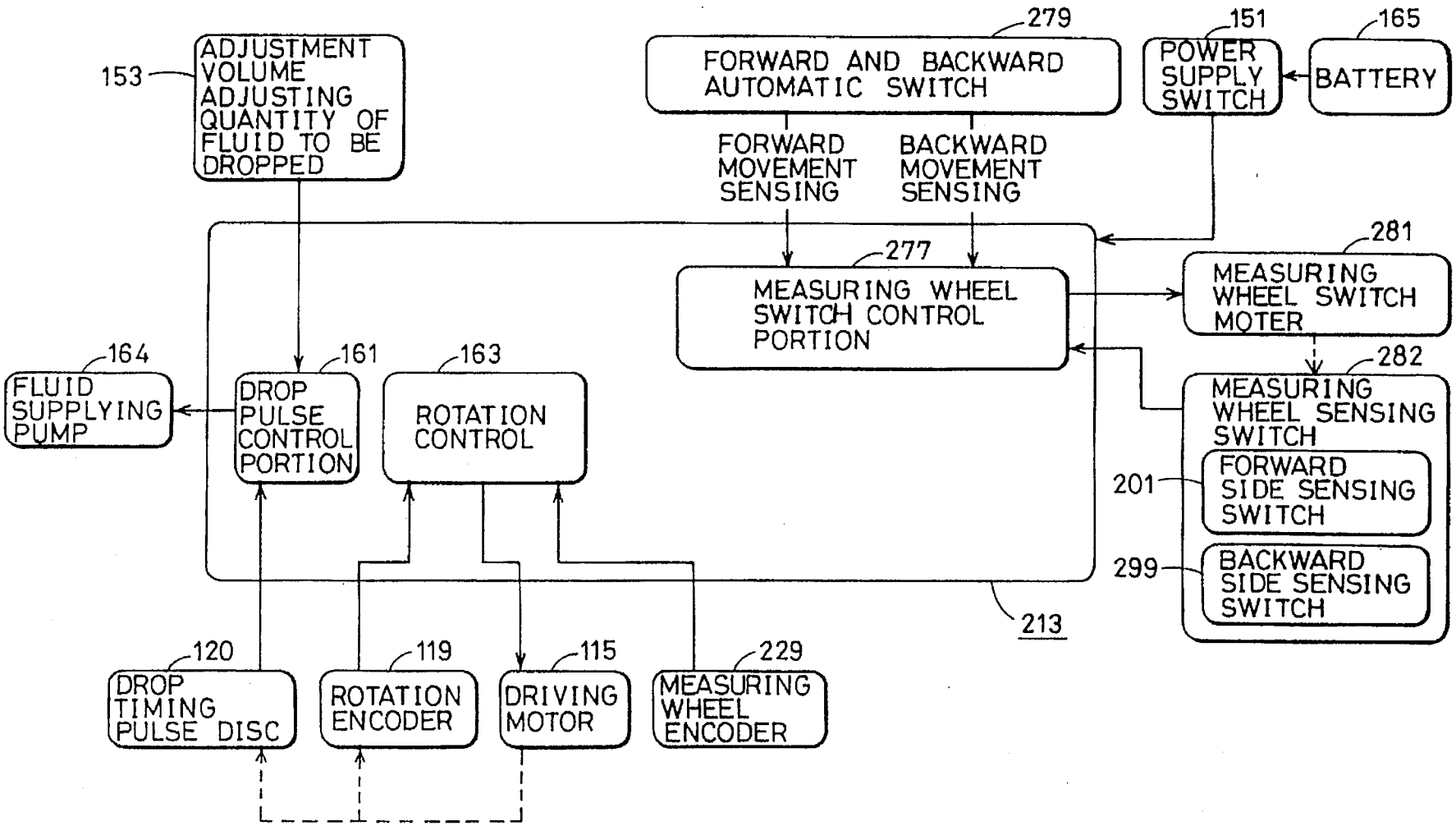
FIG. 27 is a block diagram showing the structure of a floor cleaning apparatus according to a fifth embodiment of the present invention.

FIG. 27 is a block diagram showing the structure of a floor cleaning apparatus according to the fifth embodiment of the present invention.

The floor cleaning apparatus according to this embodiment is characterized in that forward movement/backward movement of the apparatus is sensed by a switch, and that switching between forward and backward measuring wheels can be carried out by a measuring wheel switch motor.

Referring to FIG. 27, the floor cleaning apparatus according to the fifth embodiment includes, in addition to the components of the floor cleaning apparatus according to the second embodiment shown in FIG. 11, a forward and backward automatic switch 279 for sensing forward movement/backward movement of the apparatus and switching measuring wheels, a measuring wheel switch motor 281 for switching measuring wheels, and a measuring wheel sensing switch 282 for sensing end of switching of measuring wheels. Further, a control portion 213 includes a measuring wheel switch control portion 277.

Measuring wheel sensing switch 282 includes a forward side sensing switch 201 and a backward side sensing switch 299.

Figure 28:
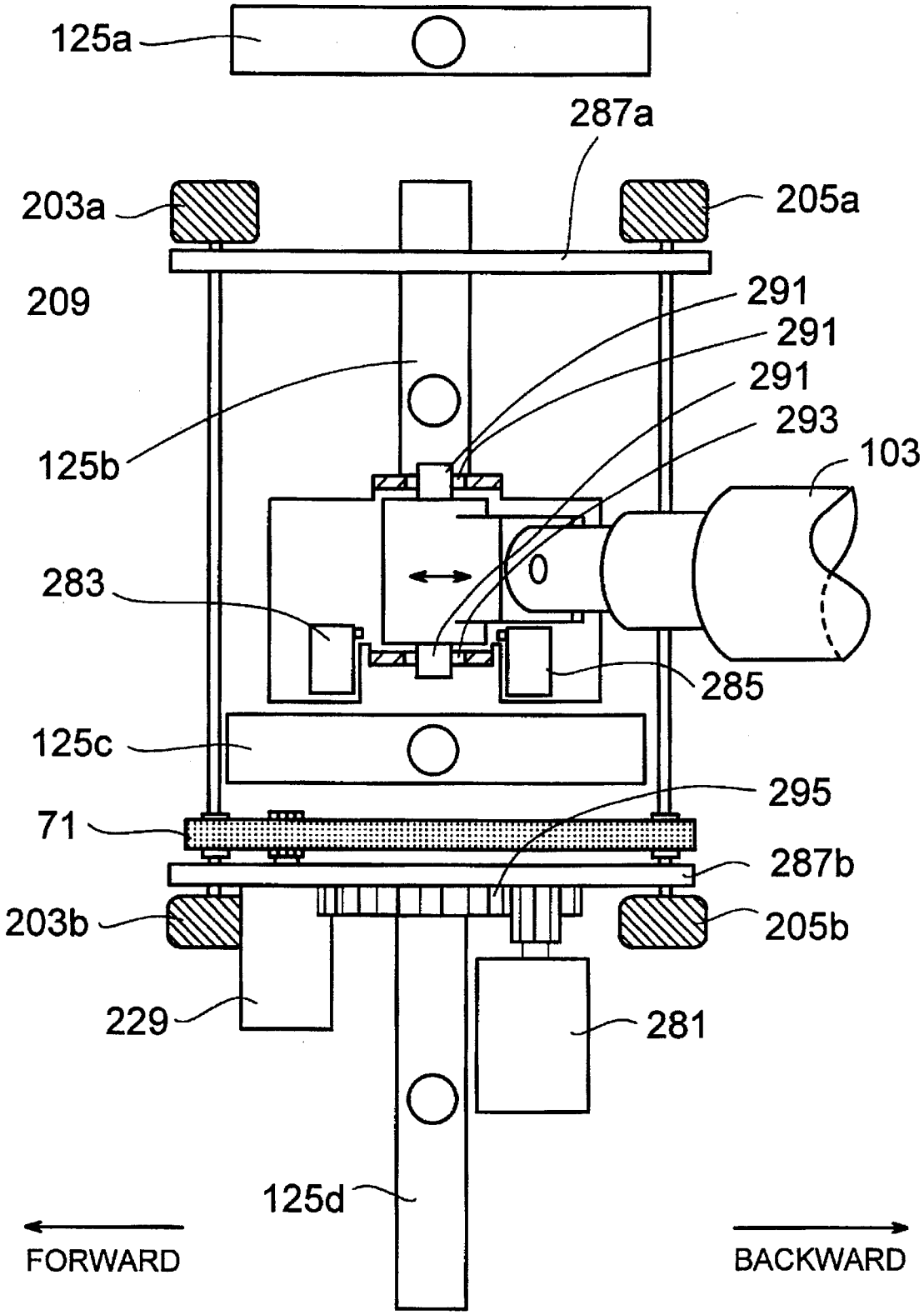
FIG. 28 is a plan view showing a mechanism of switching measuring wheels of the floor cleaning apparatus according to the fifth embodiment of the present invention.
Figure 29:
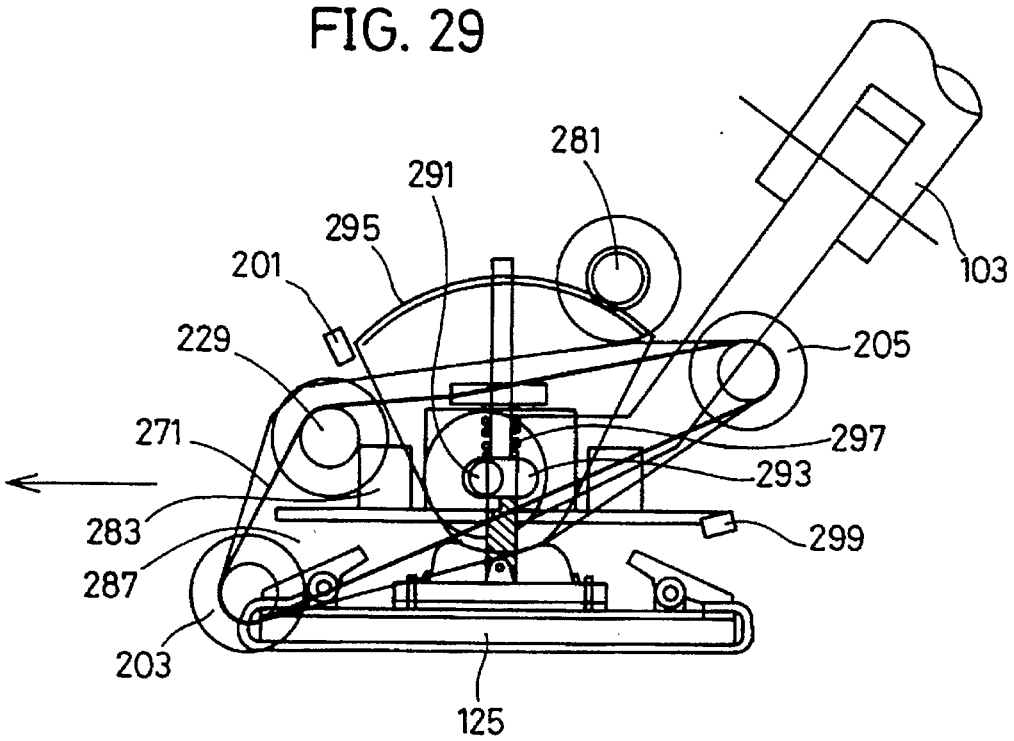
FIG. 29 is a side view showing a state in which the floor cleaning apparatus according to the fifth embodiment of the present invention moves forward.
Figure 30:
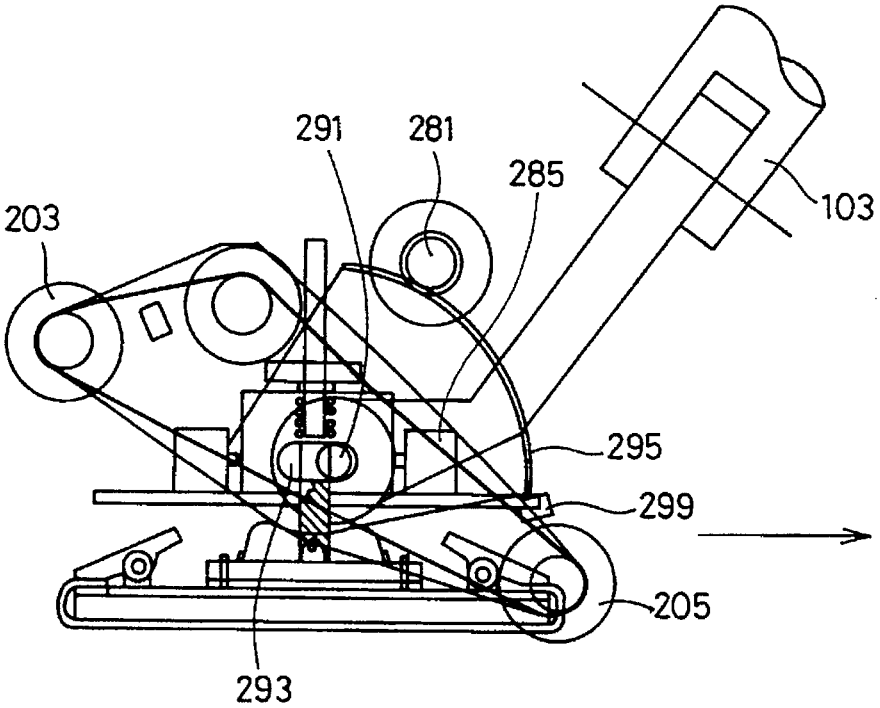
FIG. 30 is a side view showing a state in which the floor cleaning apparatus according to the fifth embodiment of the present invention moves backward.

FIG. 28 is a plan view showing a measuring wheel switch mechanism of the floor cleaning apparatus according to the fifth embodiment. FIG. 29 is a side view for explaining the state where the floor cleaning apparatus according the fifth embodiment moves forward. FIG. 30 is a plan view for explaining the state where the floor cleaning apparatus according to the fifth embodiment moves backward.

Forward measuring wheel 203 (203*a*, 203*b*) and backward measuring wheel 205 (205*a*, 205*b*) are engaged with rocking plate 287 (287*a*, 287*b*). Rotation of forward and backward measuring wheels 203 and 205 is transmitted to measuring wheel encoder 229 through speed measuring timing belt 271 bridged among forward measuring wheel 203, backward measuring wheel 205, and measuring wheel encoder 229.

Supporting portion 103 is engaged with a guide hole 293 through a slide pin 291 fixed thereto. Guide hole 293 has a long hole shape extending back and forth so that slide pin 291 can move therein, as shown in FIG. 29. The operator applies the force back and forth to the supporting portion, causing slide pin 291 to move back and forth in guide hole 293.

By slide pin 291 moving forward in guide hole 293, supporting portion 103 comes in contact with a forward automatic switch 283. By slide pin 291 moving backward in guide hole 293, part of supporting portion 103 comes in contact with a backward automatic switch 285. As a result, forward movement/backward movement of the apparatus is sensed.

Forward/backward automatic switches 283 and 285 correspond to forward and backward automatic switch 279 in the block diagram of FIG. 27.

Switching of measuring wheels is carried out by transmission of the force by measuring wheel switch motor 281 to rocking plates 287*a* and 287*b* through a measuring wheel switch gear 295 attached to rocking plates 287*a* and 287*b*.

Referring to FIG. 29, when the apparatus moves forward, the forward force is applied to supporting portion 103 by the operator. Therefore, slide pin 291 engaged with supporting portion 103 moves to the front side in guide hole 293. As a result, forward automatic switch 283 is turned on. In response to this, measuring wheel switch control portion 277 of FIG. 26 controls measuring wheel switch motor 281 so that rocking plate 287 leans forward.

When forward side sensing switch 201 senses contact with measuring wheel switch gear 295, measuring wheel switch motor 281 is controlled to stop.

As a result, when the apparatus moves forward, forward measuring wheel 203 comes in contact with the floor, and backward measuring wheel 205 comes apart from the floor.

Referring to FIG. 30, when the apparatus moves backward, the backward force is applied to supporting portion 103 by the operator. Therefore, slide pin 291 engaged with supporting portion 103 moves to the rear side in guide hole 293. As a result, backward automatic switch 285 is turned on, and measuring wheel switch motor 281 is driven until measuring wheel switch gear 295 comes in contact with backward side sensing switch 299. As a result, when the apparatus moves backward, forward measuring wheel 203 comes apart from the floor, and backward measuring wheel 205 comes in contact with the floor.

Figure 31:
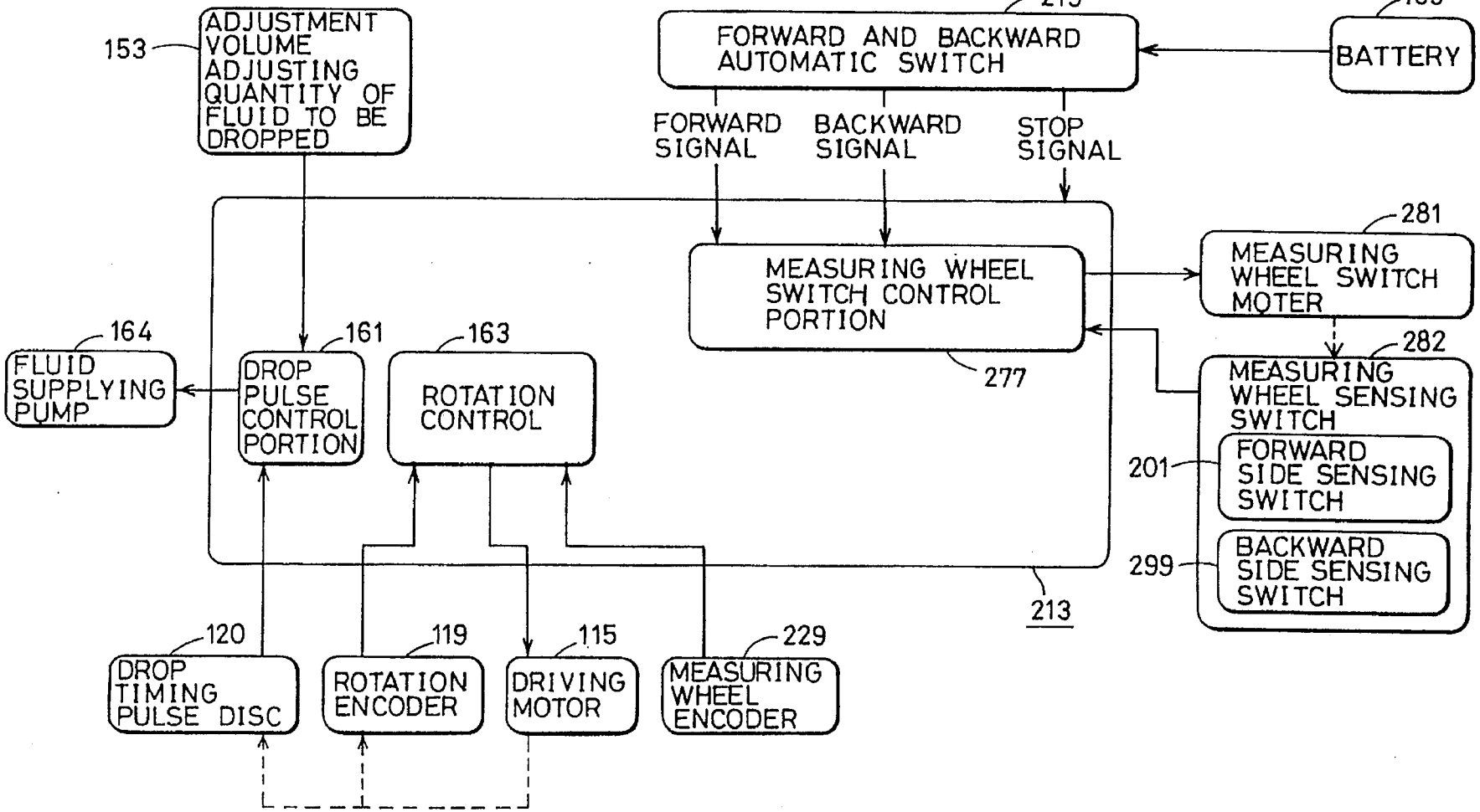
FIG. 31 is a block diagram showing the structure of a floor cleaning apparatus according to a sixth embodiment of the present invention.

FIG. 31 is a block diagram showing the structure of a floor cleaning apparatus according to the six embodiment of the present invention.

The floor cleaning apparatus according to this embodiment is characterized in that measuring wheels are switched by manual operation of the operator. More specifically, although measuring wheels are switched by forward and backward automatic switch 279 in the fifth embodiment shown in FIG. 27, the apparatus of this embodiment includes a forward and backward manual switch 219 as shown in FIG. 31, instead of forward and backward automatic switch 279 of FIG. 27. Forward and backward manual switch 219 serves also as a power supply switch.

Figure 32:
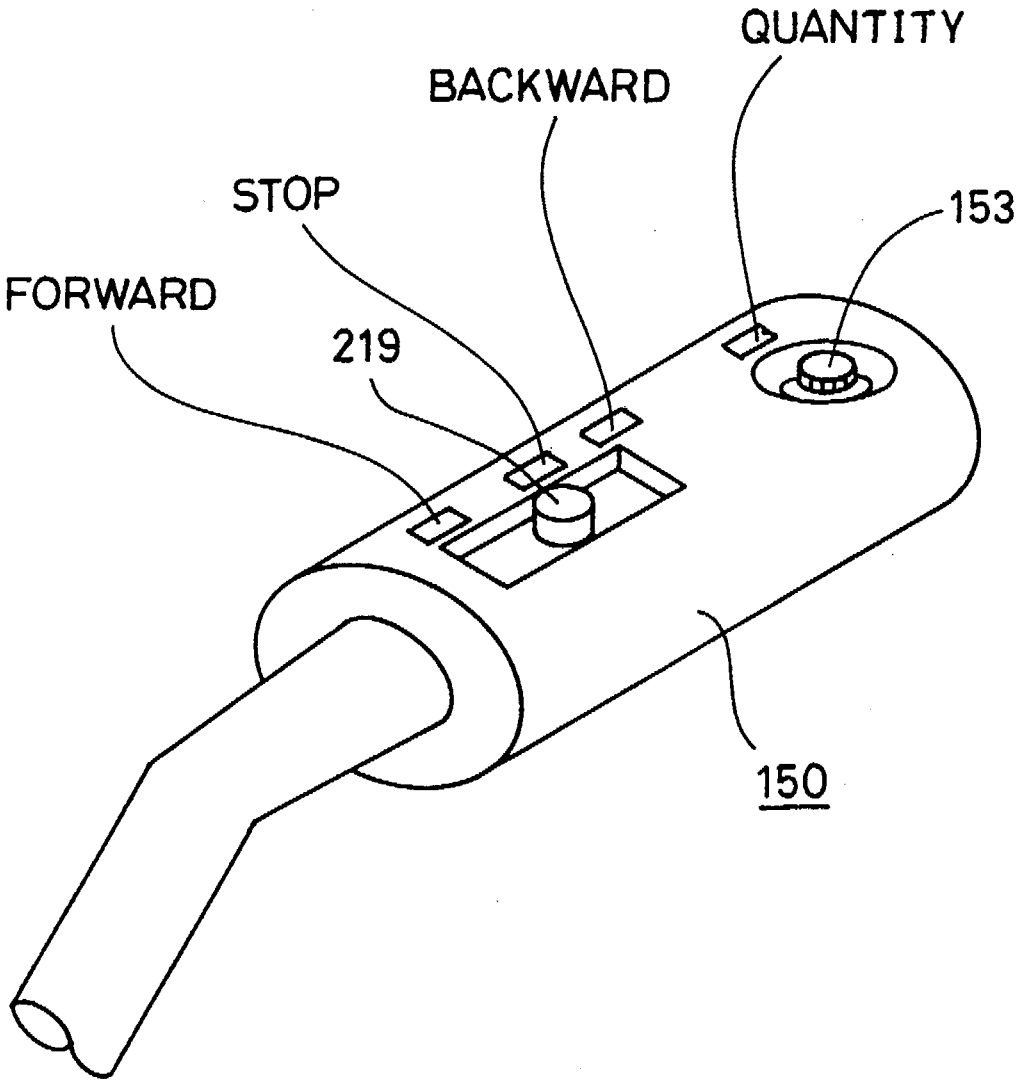
FIG. 32 is a diagram showing a grip of the floor cleaning apparatus according to the sixth embodiment of the present invention.

As shown in FIG. 32, forward and backward manual switch 219 is arranged in grip 150 together with adjustment volume 153, similarly to the case of the second embodiment shown in FIG. 7. By thus structured, forward and backward measuring wheels are switched by the operator in this embodiment.

A mechanism of switching measuring wheels by a motor is the same as that of the fourth embodiment. Therefore, the description thereof will not be repeated here.

Figure 33:
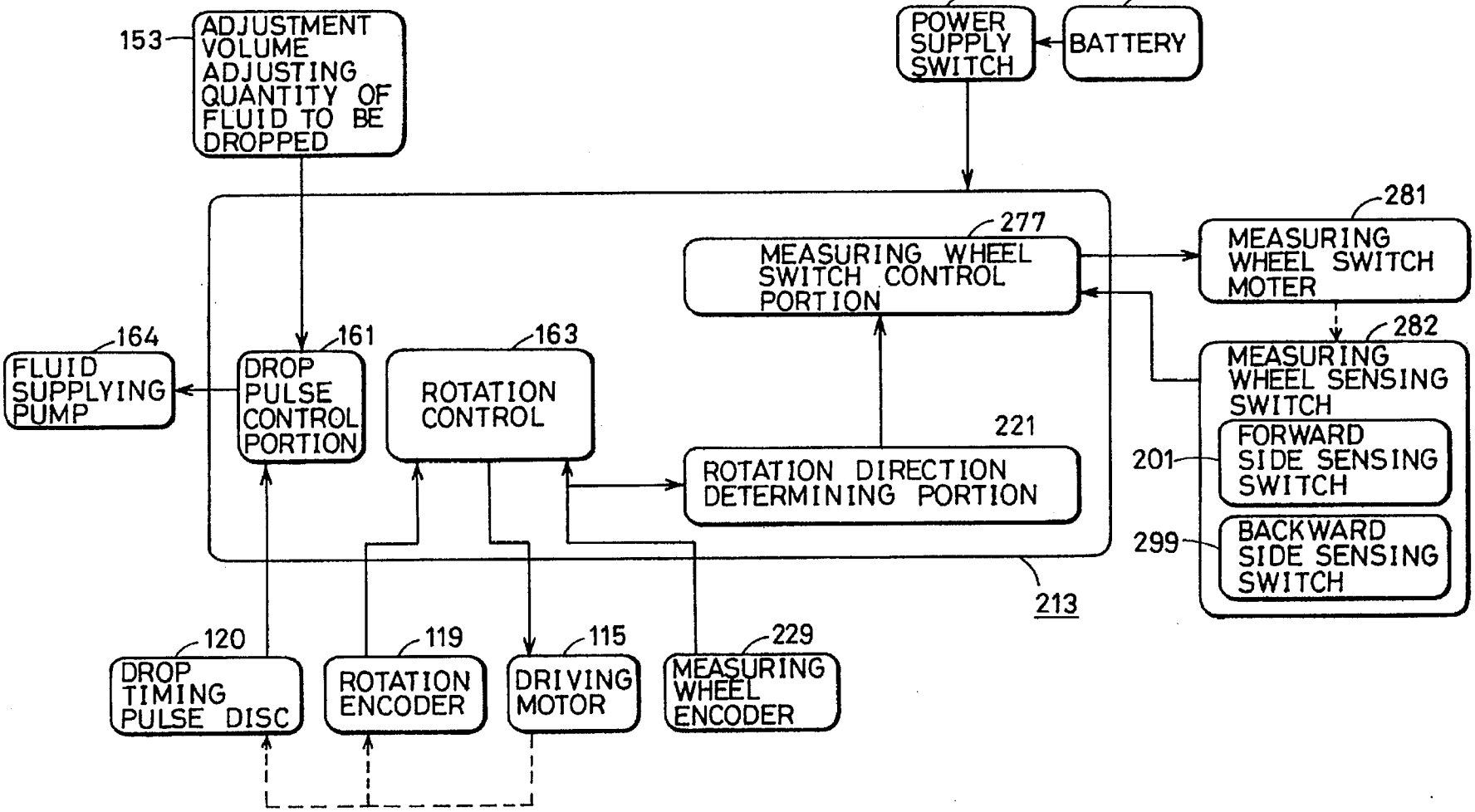
FIG. 33 is a block diagram showing the structure of a floor cleaning apparatus according to a seventh embodiment of the present invention.

FIG. 33 is a block diagram showing the structure of a floor cleaning apparatus according to the seventh embodiment of the present invention.

Referring to FIG. 33, the floor cleaning apparatus according to this embodiment is different from the floor cleaning apparatus shown in FIG. 27 in that the former does not include forward and backward automatic switch 279. Further, the floor cleaning apparatus according to this embodiment includes a determining portion 221 determining the rotation direction of the measuring wheel in control portion 213.

Determining portion 221 determines the rotation direction of the measuring wheel based on a signal from measuring wheel encoder 229. The rotation direction of the measuring wheel is based on forward movement/backward movement of the apparatus. Therefore, forward movement/backward movement of the apparatus is determined. Determining portion 221 transmits a signal for switching the measuring wheel to measuring wheel switch control portion 277, and switching control of measuring wheels is made.

Note that the measuring wheel is switched by measuring wheel switch motor 281. Since the switching mechanism is the same as that of the fifth embodiment, the description thereof will not be repeated here.

Figure 34:
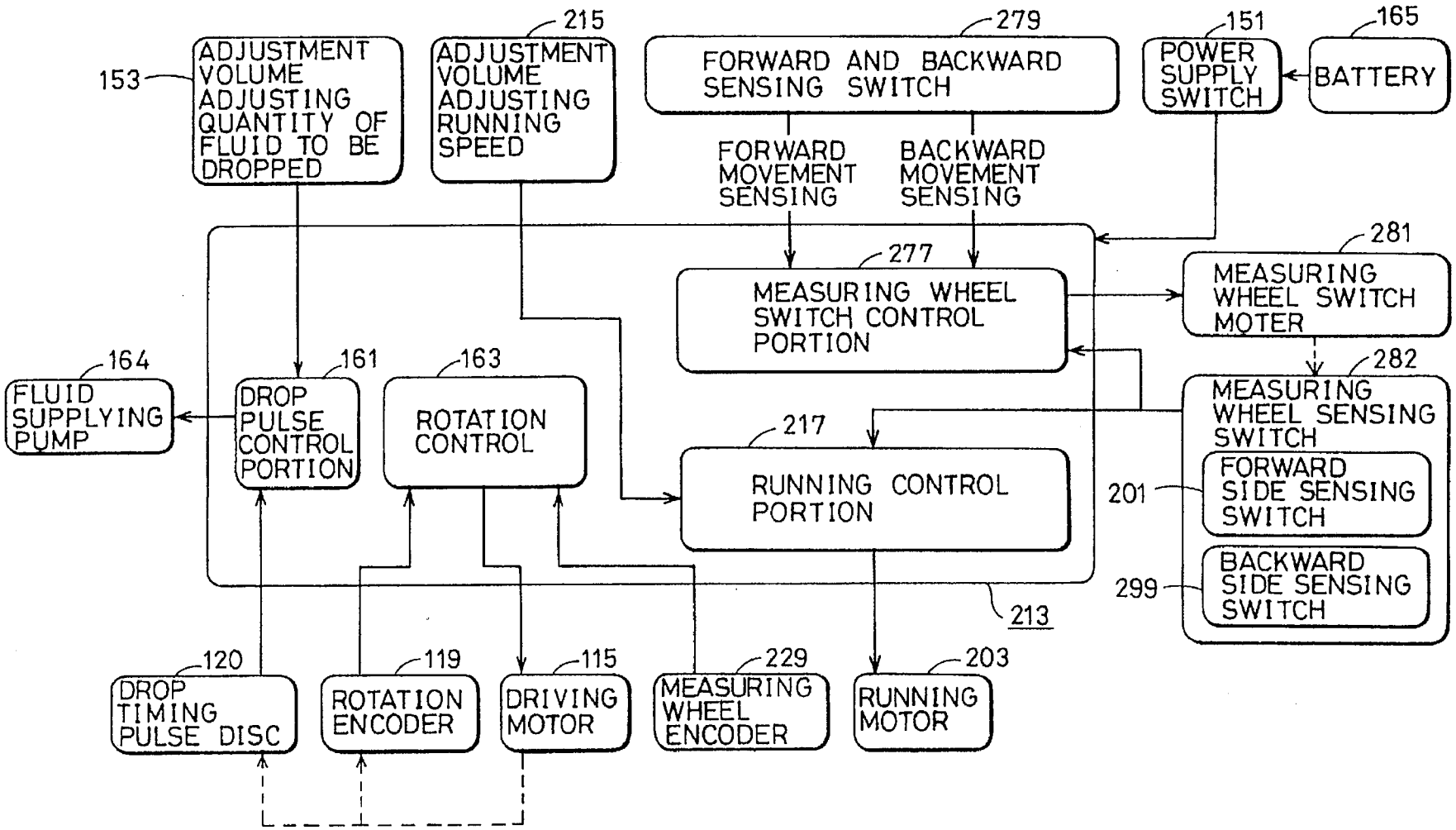
FIG. 34 is a block diagram showing the structure of a floor cleaning apparatus according to an eighth embodiment of the present invention.

FIG. 34 is a block diagram showing the structure of a floor cleaning apparatus according to the eighth embodiment of the present invention.

Referring to FIG. 34, the floor cleaning apparatus according to this embodiment includes, in addition to the components of the floor cleaning apparatus of FIG. 27, a running motor 207 for driving the apparatus, and an adjustment volume 215 for adjusting the running speed. Control portion 213 further includes a running control portion 217 controlling running motor 207.

In the floor cleaning apparatus according to this embodiment, the work load of the cleaning work is reduced by running motor 207.

Figure 35:
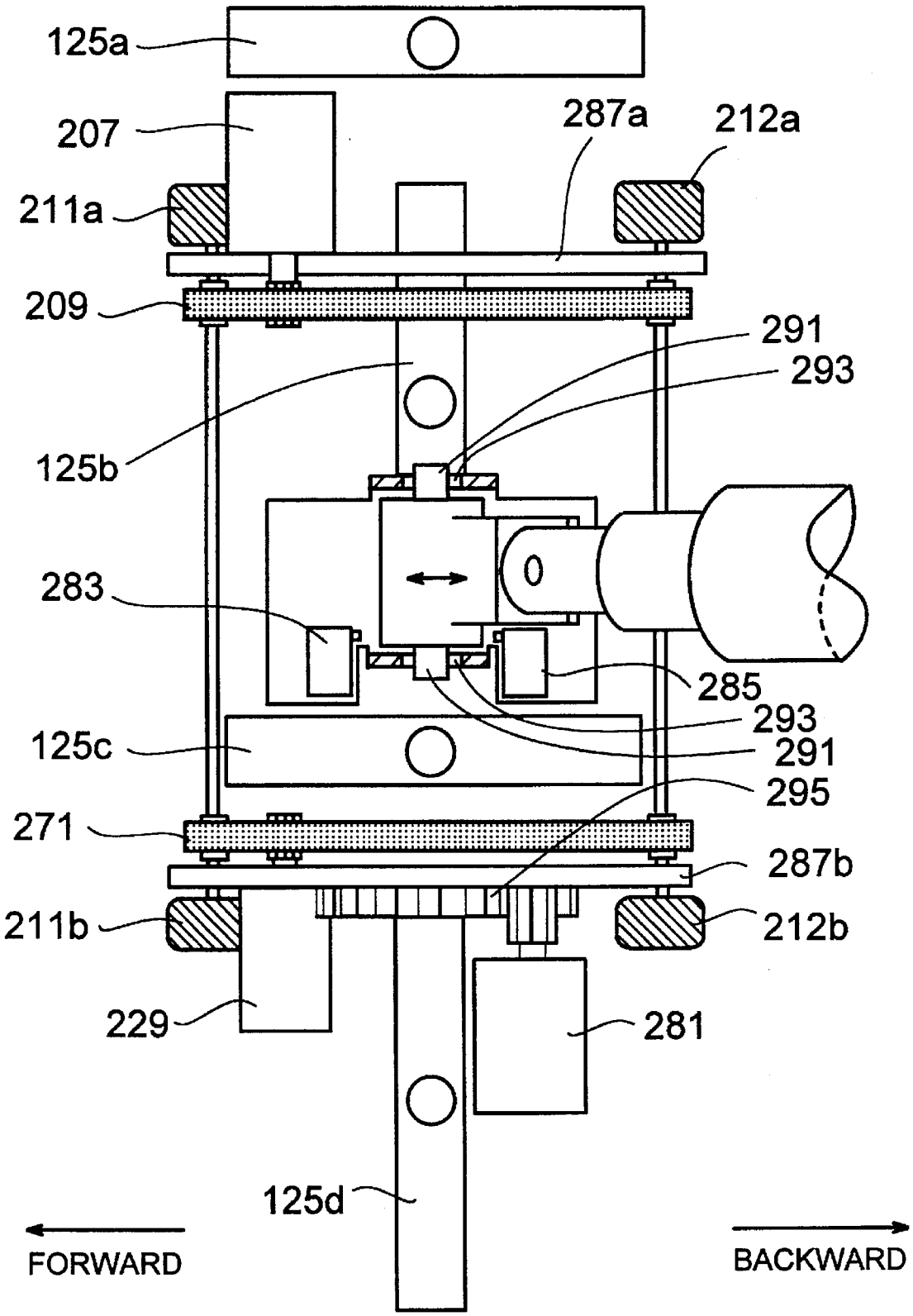
FIG. 35 is a plan view showing a mechanism of switching measuring wheels of the floor cleaning apparatus according to the eighth embodiment of the present invention.

FIG. 35 is a plan view showing a mechanism of switching measuring wheels of the floor cleaning apparatus according to the eighth embodiment.

Referring to FIG. 35, the floor cleaning apparatus according to this embodiment includes, in addition to the components of the fifth embodiment shown in FIG. 28, running motor 207 for driving the apparatus, and a running timing belt 209 for transmitting the force of running motor 207.

The floor cleaning apparatus further includes as wheels forward measuring and forward running wheels 211*a* and 211*b*, and backward measuring and backward running wheels 212*a* and 212*b* for carrying out measuring and running.

In the figure, this embodiment is the same as the fifth embodiment in that, by slide pin 291 moving in guide hole 293, forward automatic switch 283 and backward automatic switch 285 are turned on.

Referring to FIG. 34, in response to a signal from forward and backward automatic (sensing) switch 279, measuring wheel switch control portion 277 drives measuring wheel switch motor 281. A timing of end of switch of measuring wheels is sensed by measuring wheel switch sensing switch 282. A sense signal from measuring wheel sensing switch 282 is transmitted to measuring wheel control portion 277, and stops driving of measuring wheel switch motor 281. Running control portion 217 determines whether the apparatus moves forward or backward based on a signal from measuring wheel sensing switch 282, and controls running motor 207. The speed of running motor 207 is controlled by adjustment volume 215 through running control portion 217.

Figure 36:
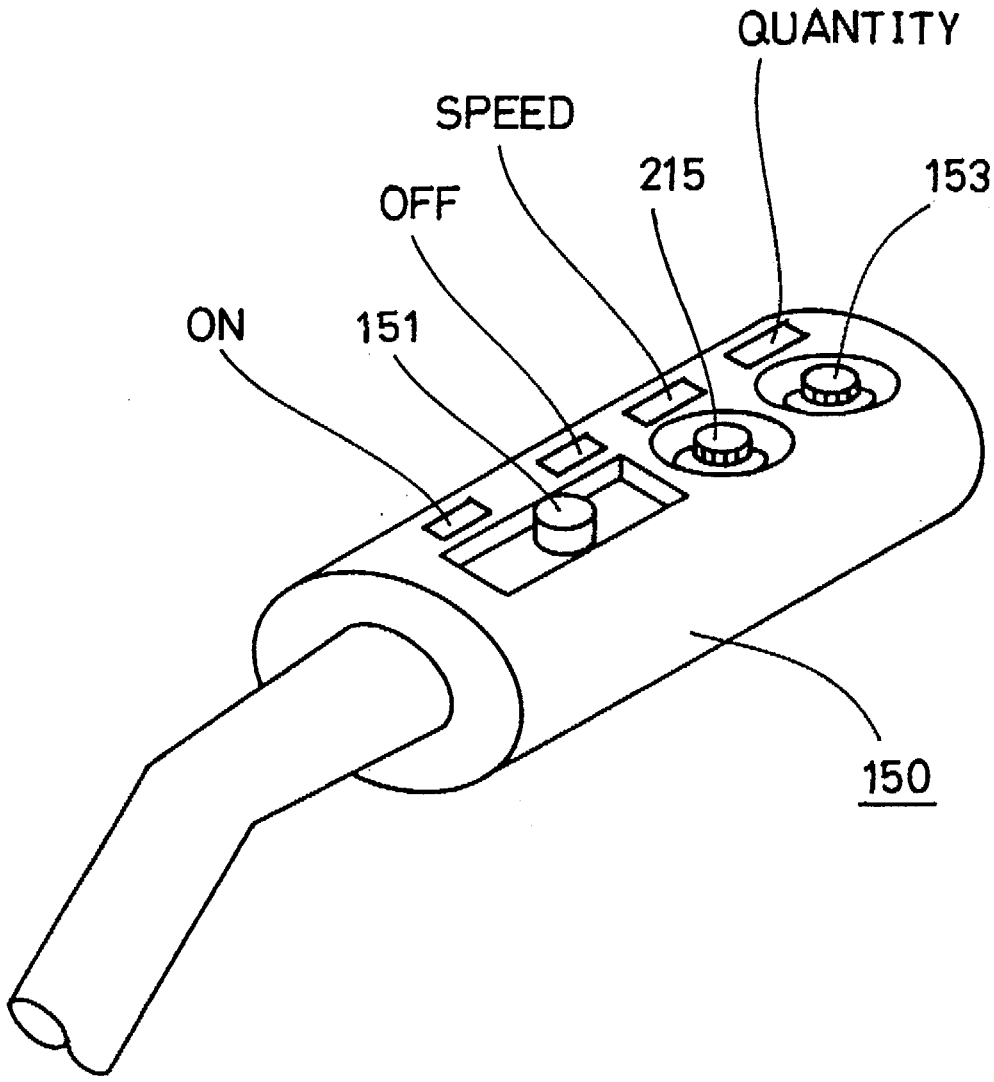
FIG. 36 is a diagram showing a grip of the floor cleaning apparatus according to the eighth embodiment of the present invention.

Power supply switch 151, adjustment volume 215 adjusting the running speed, and adjustment volume 153 adjusting the quantity of the fluid to be dropped are arranged in grip 150, as shown in FIG. 36.

Figure 37:
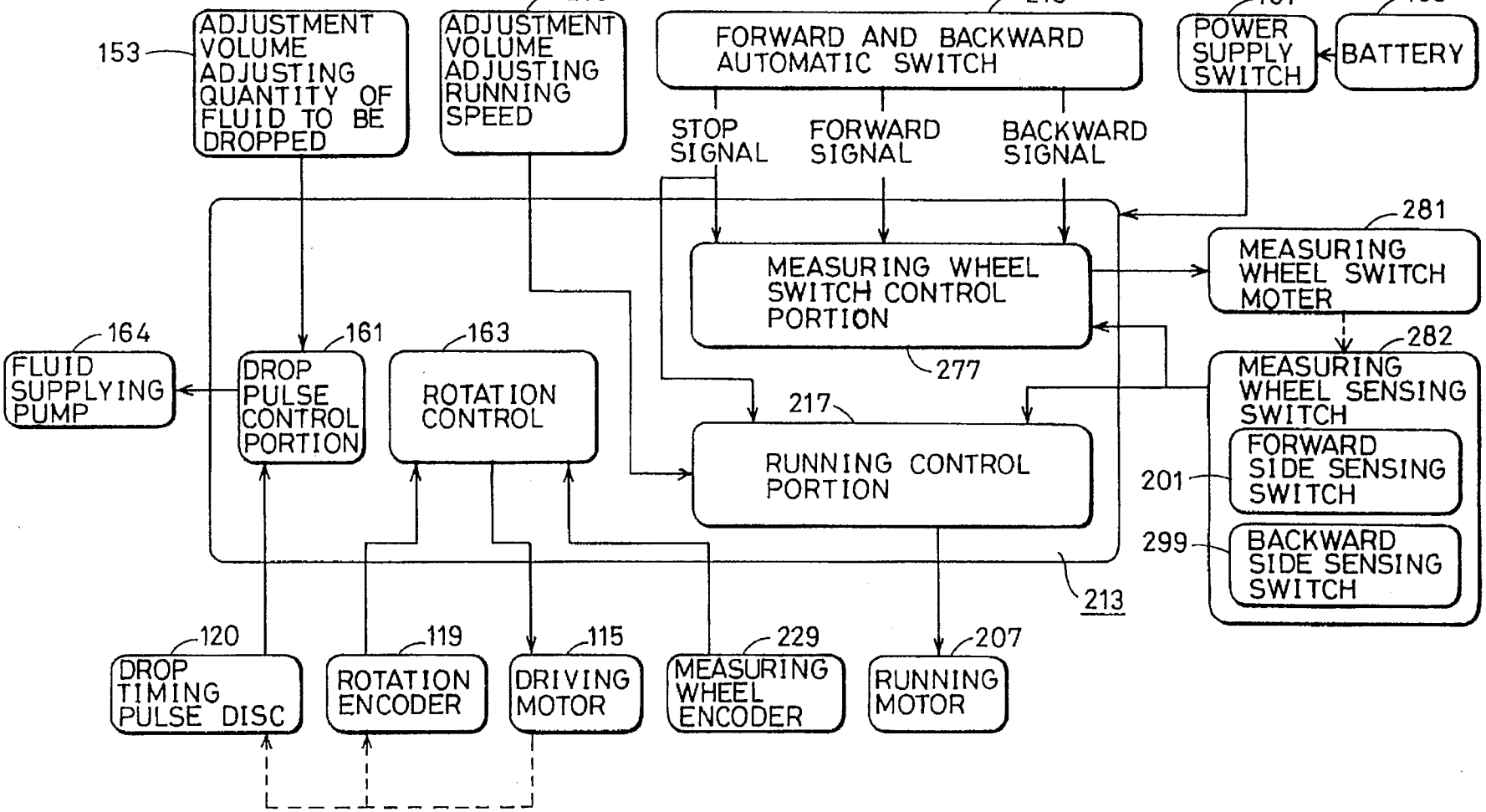
FIG. 37 is a block diagram showing the structure of a floor cleaning apparatus according to a ninth embodiment of the present invention.

FIG. 37 is a block diagram showing the structure of a floor cleaning apparatus according to the ninth embodiment of the present invention.

Figure 38:
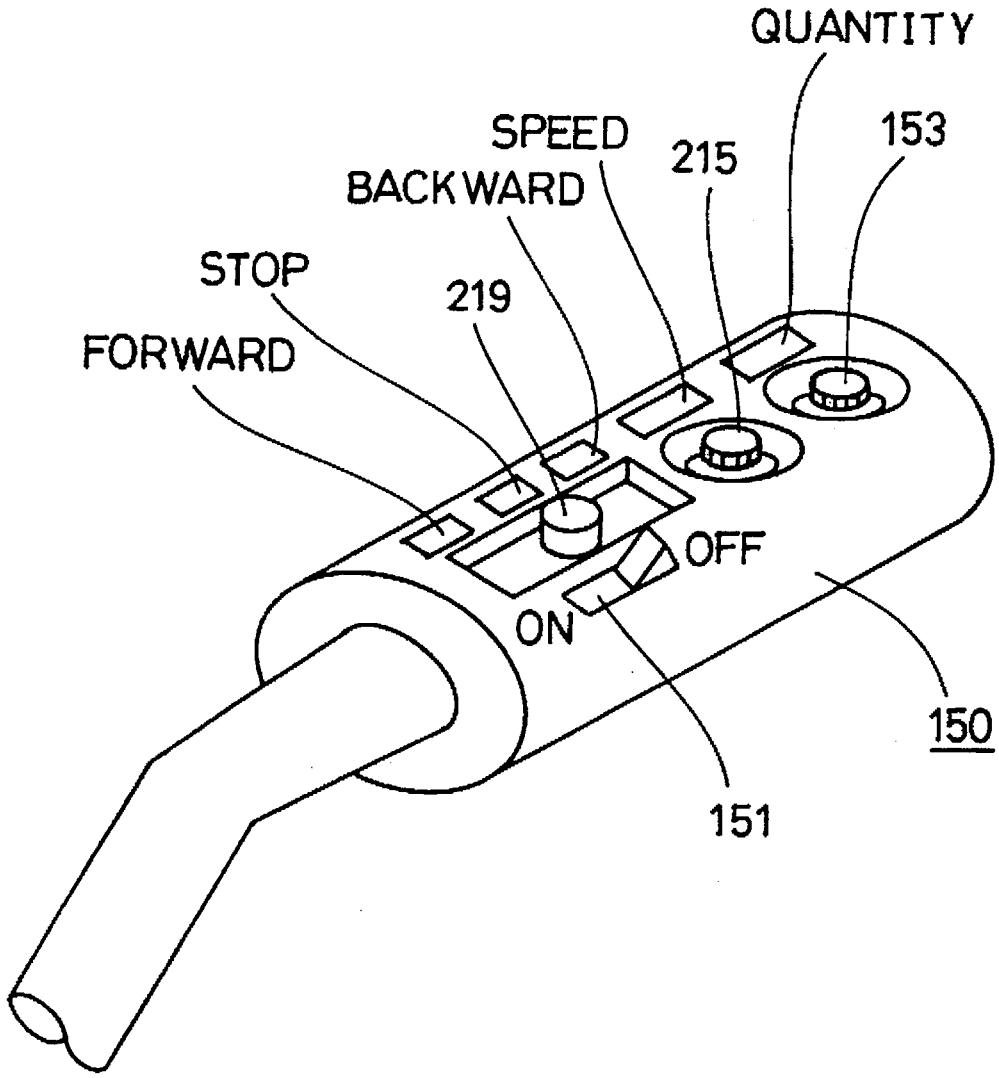
FIG. 38 is a diagram showing a grip of the floor cleaning apparatus according to the ninth embodiment of the present invention.

Referring to FIG. 37, the floor cleaning apparatus according to this embodiment includes forward and backward manual switch 219 in place of forward and backward automatic switch 279 of the floor cleaning apparatus according to the eighth embodiment shown in FIG. 34. Forward and backward manual switch 219 is arranged in grip 150 together with adjustment volume 215 for adjusting the running speed and adjustment volume 153 for adjusting the quantity of the fluid to be dropped, as shown in FIG. 38. In response to operation of forward and backward manual switch 219 by the operator, the measuring wheel and the running speed of the apparatus by running motor 207 are switched.

As shown in FIG. 38, forward and backward manual switch 219 has "stop" in addition to "forward" and "backward". When the operator selects "stop", running control portion 217 stops running motor 207 in response to the signal. Simultaneously, measuring wheel switch control portion 277 controls measuring wheel switch motor 281 so that both the forward measuring wheel and the backward measuring wheel come apart from the floor. Since only the nonwoven fabric cloth turntable (rotating body) is rotated and the fluid is supplied with both measuring wheels coming apart from the floor and running motor 207 stopped, the operator can carry out the cleaning work by moving the apparatus back and forth and right and left as if he carries out the ordinary mopping work. In order to stop the nonwoven fabric cloth turntable, the operator has only to turn off power supply switch 151.

Figure 39:
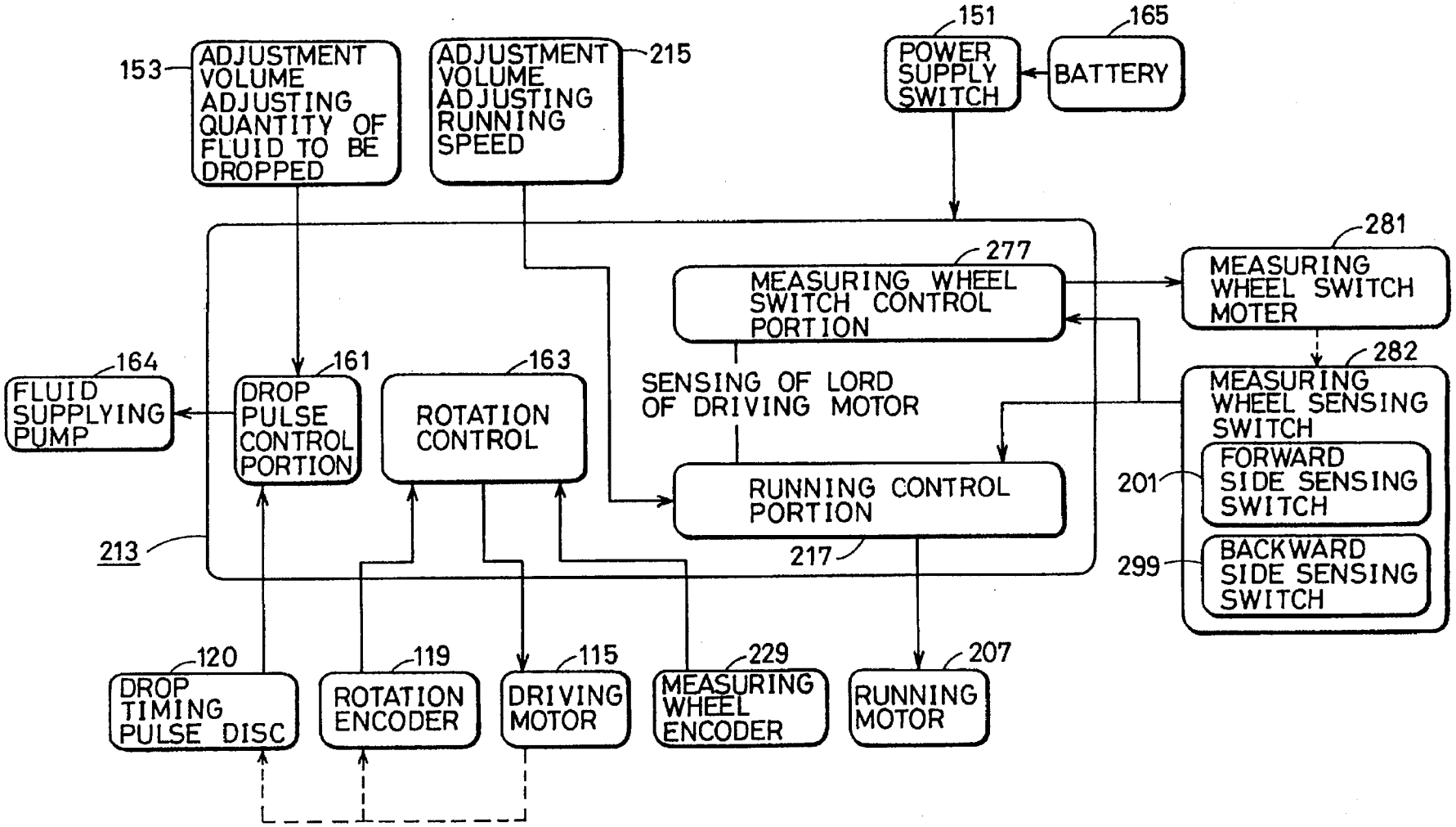
FIG. 39 is a block diagram showing the structure of a floor cleaning apparatus according to a tenth embodiment of the present invention.

FIG. 39 is a block diagram showing the structure of a floor cleaning apparatus according to the tenth embodiment of the present invention.

Referring to FIG. 39, the floor cleaning apparatus according to this embodiment does not include forward and backward automatic switch 279, unlike the floor cleaning apparatus according to the eighth embodiment shown in FIG. 34.

Running control portion 217 measures the load of running motor 207. If the load of running motor 207 is a predetermined value or more, it indicates that the force has been applied by the operator to the direction opposite to the running direction of the apparatus. Therefore, running control portion 217 transmits a signal for switching the measuring wheel to measuring wheel switch control portion 277. As a result, the measuring wheel is switched.

Figure 40:
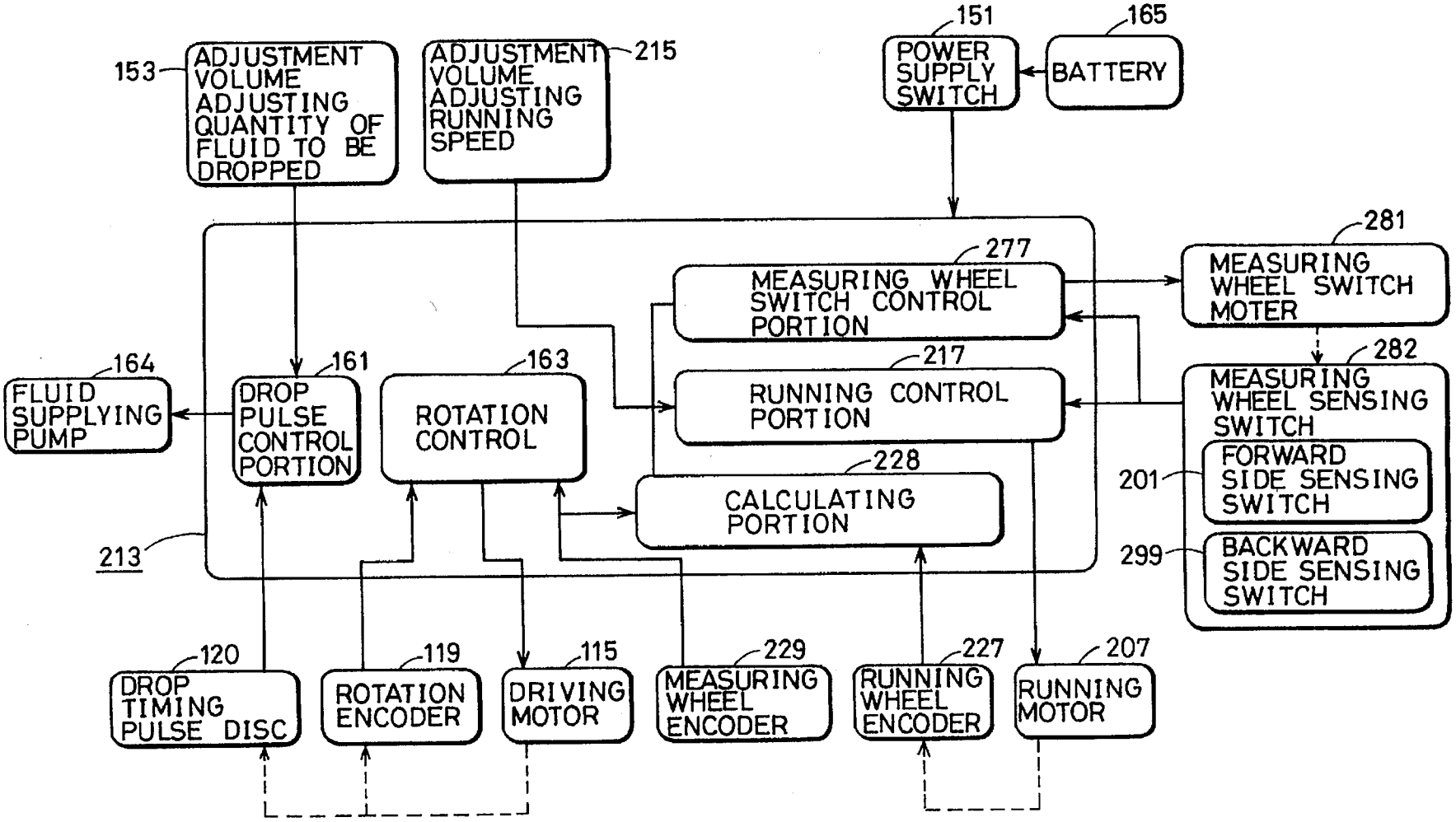
FIG. 40 is a block diagram showing the structure of a floor cleaning apparatus according to an eleventh embodiment of the present invention.

FIG. 40 is a block diagram showing the structure of a floor cleaning apparatus according to the eleventh embodiment of the present invention.

Referring to FIG. 40, the floor cleaning apparatus according to this embodiment is different from the floor cleaning apparatus shown in FIG. 37 in that the former does not include forward and backward manual switch 219, and that the former includes a running wheel encoder 227 sensing rotation of the running wheel. Further, control portion 213 includes a calculating portion 228 calculating the difference in rotation speed between the measuring wheel and the running wheel.

Figure 41:
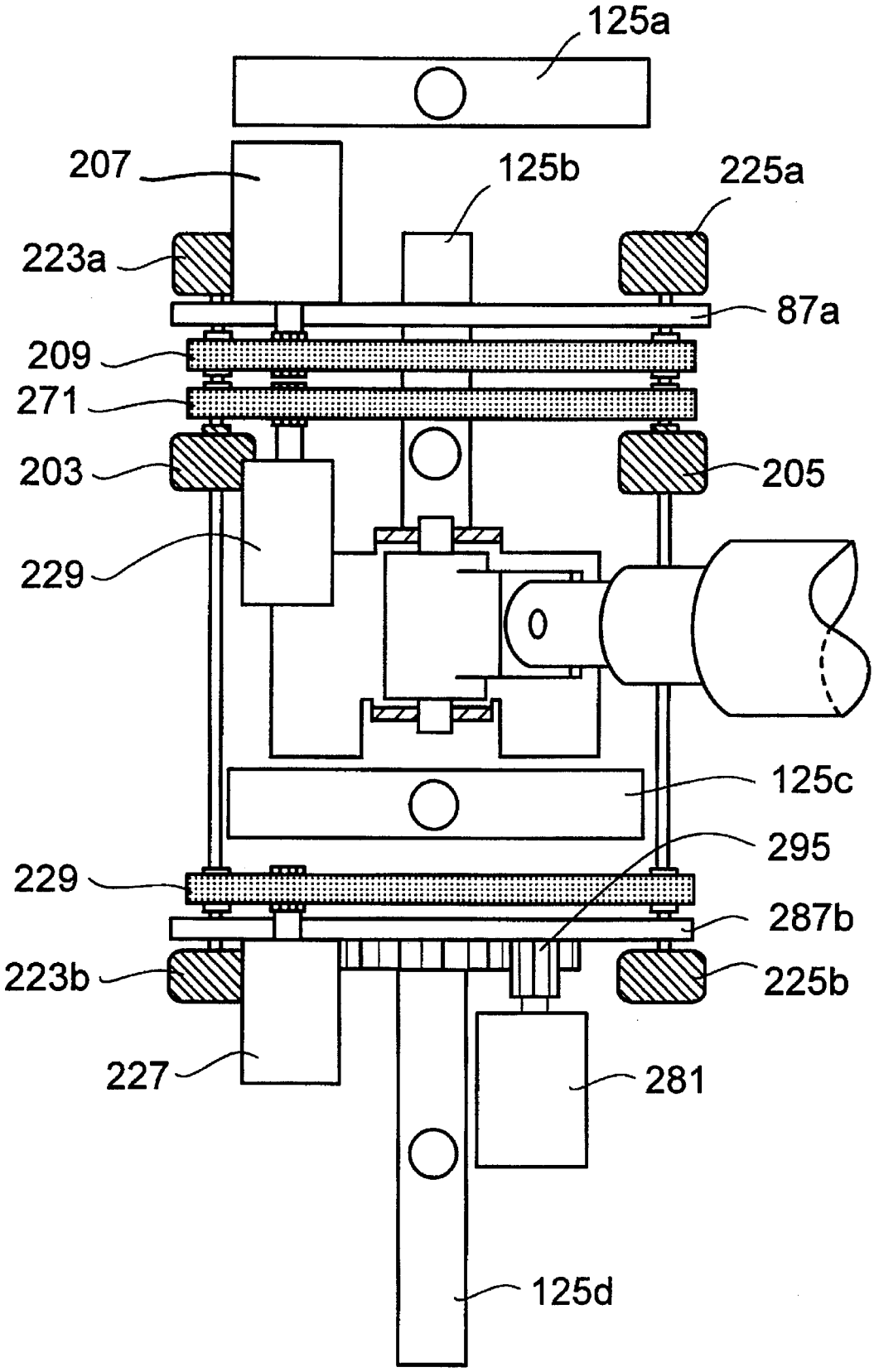
FIG. 41 is a plan view showing a mechanism of switching measuring wheels of the floor cleaning apparatus according to the eleventh embodiment of the present invention.

FIG. 41 is a plan view showing a switching mechanism of the measuring wheel of the floor cleaning apparatus according to the eleventh embodiment.

Referring to FIG. 41, the floor cleaning apparatus according to this embodiment includes nonwoven fabric cloth turntables 125*a* to 125*d*, forward running wheels 223*a* and 223*b* coming in contact with the floor when the apparatus moves forward, backward running wheels 225*a* and 225*b* coming in contact with the floor when the apparatus moves backward, running motor 207 driving forward and backward running wheels through running timing belt 209, running wheel encoder 227 sensing rotation of front and rear running wheels 223*a*, 223*b*, 225*a*, and 225*b* through running wheel speed measuring timing belt 233, forward measuring wheel 203 coming in contact with the floor when the apparatus moves forward and rotating independently of the front and rear running wheels, backward measuring wheel 205 coming in contact with the floor when the apparatus moves backward and rotating independently of the front and rear running wheels, measuring wheel encoder 229 measuring rotation of the front and rear measuring wheels through speed measuring timing belt 271, rocking plates 287*a* and 287*b* engaged with front and rear running wheels 223*a*, 223*b*, 225*a*, and 225*b*, front and rear measuring wheels 203 and 205, and the like, and a measuring wheel switch motor 281 driving the rocking plates through measuring wheel switch gear 295.

Running wheel encoder 227 rotates in synchronism with running motor 207, and measuring wheel encoder 229 rotates based on change of the positional relationship between the apparatus and the floor. When the apparatus runs ordinarily, the rotation speed of running wheel encoder 227 is approximately the same as that of measuring wheel encoder 229. However, when the force is applied by the operator to the direction opposite to the running direction of the apparatus, a difference is produced between the rotation speed of running wheel encoder 227 and the rotation speed of measuring wheel encoder 229. Calculating portion 228 shown in FIG. 40 calculates the difference in rotation speed between running wheel encoder 227 and measuring wheel encoder 229. If the difference is larger than a predetermined value, calculating portion 228 determines that the running direction has been changed, and sends a signal for switching the running direction and the measuring wheel to measuring wheel switch control portion 277. As a result, the running direction and the measuring wheel are switched.

In the above embodiments, the present invention was described taking the work of cleaning the floor as an example. However, the present invention can be applied to an apparatus cleaning not only the floor but also a wall surface.

Further, the present invention can be applied to an apparatus which carries out not only cleaning but also application of paint, for example.

Further, a rocking plate was used as a method of switching the measuring wheel in the above embodiments. However, the measuring wheel may be switched by moving front and rear measuring wheels up and down by an actuator or the like.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A spreading apparatus which spreads a fluid on a surface, comprising:

a working unit having a working member which moves along a predetermined path so as to spread the fluid on the surface;

a supplier having an outlet through which the fluid is applied onto the surface, said outlet being located over the path of the working member; and a controller which prevents operation of said supplier when the working member is immediately under the outlet.

2. The spreading apparatus as claimed in claim 1, wherein the fluid is wax for finishing the surface.

3. The spreading apparatus as claimed in claim 1, wherein the working member has a rectangular configuration, and the working member is rotatable around an axis perpendicular to the surface so as to move along a circular path.

4. The spreading apparatus as claimed in claim 3, wherein a length of the working member is shortened on one side so that a first end of the working member is positioned closer to a rotational center of the working member than a second end of the working member.

5. The spreading apparatus as claimed in claim 3, wherein said working unit includes at least two working members, and circular paths formed by the two working members are partially overlapped in an overlapped area.

6. The spreading apparatus as claimed in claim 5, wherein the outlet is located over the overlapped area, and said supplier applies the fluid onto the overlapped area.

7. The spreading apparatus as claimed in claim 3, wherein said working unit includes at least two working members, one of said working members being driven in a first direction, and the other being driven in a second direction opposite to the first direction.

8. The spreading apparatus as claimed in claim 3, wherein said working unit includes at least two working members, one of said working members being rotated with a first phase, and the other being rotated with a second phase different from the first phase.

9. The spreading apparatus as claimed in claim 1, further comprising:

a sensor detecting the working member being immediately under the outlet, wherein said controller prevents operation of said supplier based on an output of said sensor.

10. The spreading apparatus as claimed in claim 9, wherein the sensor is a photosensor.

11. The spreading apparatus as claimed in claim 9, wherein said working unit includes at least two working members, and the sensor detects each working member being immediately under the outlet.

12. The spreading apparatus as claimed in claim 1, wherein said controller controls said supplier so as to apply the fluid each time the working member moves along the path a predetermined number of times.

13. The spreading apparatus as claimed in claim 1, wherein said spreading apparatus is moved along the surface by one of an operator and a moving source provided as a component of said spreading apparatus.

14. The spreading apparatus as claimed in claim 13, further comprising:

a speed detector detecting a moving speed of said spreading apparatus, wherein the working member has a rectangular configuration, and the working member is rotatable around an axis perpendicular to the surface so as to move along a circular path, and said controller controls a rotating speed of the working member based on an output of said speed detector.

15. The spreading apparatus as claimed in claim 13, further comprising:

a speed detector detecting a moving speed of said spreading apparatus, wherein said controller controls the quantity of applied fluid based on an output of said speed detector.

16. The spreading apparatus as claimed in claim 1, further comprising:

a motor which moves the working member, wherein said working unit includes at least two working members, and the motor moves all the working members.

17. The spreading apparatus as claimed in claim 1, wherein the working member comprises nonwoven fabric cloth.

18. The spreading apparatus as claimed in claim 17, wherein the working member further comprises a rotating member, and wherein said nonwoven fabric cloth is detachably attached to the rotating member.

19. A spreading apparatus which spreads a fluid on a surface, comprising:

a working unit including at least two working members having first and second ends which are rotated around axes perpendicular to the surface so as to spread the fluid on the surface, one of the working members being rotated with a first phase, and the other being rotated with a second phase different from the first phase;

wherein a length of each working member is shortened on one side of the rotational axis so that the first end of each working member is positioned closer to a rotational center of each working member than the second end of each working member; and a supplier having an outlet through which the fluid is applied to the surface, said outlet being located over a path of the second end, but not over a path of the first end.

20. The spreading apparatus as claimed in claim 19, wherein the working members each have a rectangular configuration.

21. The spreading apparatus as claimed in claim 19, wherein circular paths formed by the two working members are partially overlapped.

22. The spreading apparatus as claimed in claim 19, wherein one of the working members is driven in a first direction, and the other is driven in a second direction opposite to the first direction.

23. The spreading apparatus as claimed in claim 19, further comprising:

a motor which rotates all the working members.

* * * * *